US008317181B2

(12) United States Patent
Suzuki

(10) Patent No.: US 8,317,181 B2
(45) Date of Patent: Nov. 27, 2012

(54) SPINE FORMATION DEVICE, SHEET PROCESSING SYSTEM INCORPORATING SAME, AND SPINE FORMATION METHOD

(75) Inventor: Nobuyoshi Suzuki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/200,591

(22) Filed: Sep. 27, 2011

(65) Prior Publication Data

US 2012/0087765 A1 Apr. 12, 2012

(30) Foreign Application Priority Data

Oct. 8, 2010 (JP) ..... 2010-228824

(51) Int. Cl.
*B31F 1/10* (2006.01)

(52) U.S. Cl. ..... 270/45; 270/58.07

(58) Field of Classification Search ..... 270/32, 270/45, 51, 58.07; 493/406, 407, 442, 454; 412/22

See application file for complete search history.

(56) References Cited

U.S. PATENT DOCUMENTS

| | | | | |
|---|---|---|---|---|
| 6,692,208 | B1 | 2/2004 | Watkiss et al. | |
| 2007/0120310 | A1 * | 5/2007 | Awano | 270/45 |
| 2010/0258994 | A1 | 10/2010 | Kikkawa et al. | |
| 2010/0303585 | A1 | 12/2010 | Asami et al. | |
| 2010/0310340 | A1 | 12/2010 | Suzuki et al. | |
| 2011/0064541 | A1 | 3/2011 | Kikkawa et al. | |
| 2011/0091259 | A1 | 4/2011 | Kobayashi et al. | |
| 2011/0103863 | A1 | 5/2011 | Asami et al. | |
| 2011/0103919 | A1 | 5/2011 | Furuhashi et al. | |
| 2011/0103921 | A1 | 5/2011 | Suzuki et al. | |
| 2011/0229287 | A1 | 9/2011 | Suzuki | |

FOREIGN PATENT DOCUMENTS

| | | |
|---|---|---|
| EP | 1 138 521 | 10/2001 |
| JP | 2001-260564 A | 9/2001 |
| JP | 2004-210436 | 7/2004 |
| JP | 2006-036493 A | 2/2006 |
| JP | 2009-274393 A | 11/2009 |
| JP | 2010-064870 A | 3/2010 |

OTHER PUBLICATIONS

Search Report dated Dec. 23, 2011 isued in corresponding European Application No. 11183608.6

* cited by examiner

*Primary Examiner* — Leslie A Nicholson, III
(74) *Attorney, Agent, or Firm* — Harness, Dickey & Pierce, P.L.C.

(57) ABSTRACT

A spine formation device includes a sheet conveyer to transport a bundle of folded sheets with the folded portion of the bundle forming a front end portion of the bundle, a clamping unit to clamp the bundle from both sides in a direction of thickness of the bundle, a spine forming member to flatten the folded portion of the bundle, disposed in that order in a sheet conveyance direction, and a controller that causes the sheet conveyer to transport the bundle of folded sheets to a first position downstream from an upstream end of the spine forming member in the sheet conveyance direction and to reverse the bundle a predetermined distance from the first position to a second position upstream from the first position in the sheet conveyance direction before the clamping unit clamps the bundle.

8 Claims, 24 Drawing Sheets

SPINE FORMATION DEVICE, SHEET PROCESSING SYSTEM INCORPORATING SAME, AND SPINE FORMATION METHOD

CROSS-REFERENCE TO RELATED APPLICATIONS

This patent application is based on and claims priority pursuant to 35 U.S.C. §119 to Japanese Patent Application No. 2010-228824, filed on Oct. 8, 2010, in the Japan Patent Office, the entire disclosure of which is hereby incorporated herein by reference.

FIELD OF THE INVENTION

The present invention generally relates to a spine formation device to form a spine of a bundle of folded sheets, an image forming system including the spine formation device, a sheet processing system including the spine formation device, and a method of forming a spine of a bundle of folded sheets.

BACKGROUND OF THE INVENTION

Post-processing apparatuses to perform post processing of sheets, such as, aligning, sorting, stapling, punching, and folding of sheets are widely used and are often disposed downstream from an image forming apparatus to perform post-processing of the sheets output from the image forming apparatus. At present, post-processing apparatuses generally perform saddle-stitching, that is, stitching or stapling a bundle of sheets along its centerline, in addition to conventional edge-stitching along an edge portion of sheets. Therefore, to improve the quality of output sheets, several approaches to shape the folded portion of a bundle of saddle-stitched sheets have been proposed.

More specifically, when a bundle of sheets is saddle-stitched or saddle-stapled and then folded in two (hereinafter "booklet"), the folded portion around its spine tends to bulge, degrading the overall appearance of the booklet. In addition, because the bulging spine makes the booklet thicker on the spine side and thinner on the opposite side, when the booklets are piled together with the bulging spines on the same side, the piled booklets tilt more as the number of the booklets increases. Consequently, the booklets might fall over when piled together.

Therefore, in saddle-stitching or saddle-stapling, which is widely used as a simple bookbinding method, it is preferred to reduce bulging of the spine of the bundle of sheets thus bound, that is, to flatten the spine of the booklet. When the spine of the booklet is flattened, bulging of the booklet can be reduced, and accordingly multiple booklets can be piled together. This flattening is important for ease of storage and transport because it is difficult to stack booklets together if their spines bulge, making it difficult to store or carry them. With this reformation, relatively large number of booklets can be piled together. It is to be noted that the term "spine" used herein means not only the stitched or stapled side of the booklet but also portions of the front cover and the back cover continuous with the spine.

For example, in JP-2001-260564-A, the spine of the booklet is flattened using a pressing member configured to clamp simultaneously, from a front cover side and a back cover side of the booklet, an end portion of the booklet adjacent to the spine, and a spine forming roller configured to roll along the spine longitudinally. The spine forming roller moves at least once over the entire length of the spine of the booklet being fixed by the pressing member while applying to the spine a pressure sufficient to flatten the spine. Hereinafter the above-described mechanism is referred to as a spine formation mechanism.

Although this approach can flatten the spine of the booklet to a certain extent, it is possible that the sheets might wrinkle and be torn around the spine or folded portion because the pressure roller applies localized pressure to the spine continuously. In addition, although generally not noticeable, it is possible that the sheets might wrinkle inside the folded portion.

More specifically, referring to FIG. 1, the spine formation mechanism flattens a leading edge portion SA1 of a booklet SA to make a square spine SA2 shown in FIG. 2A. However, in the above-described approach, wrinkles SA3 can be created on the inner side of the booklet SA as shown in FIG. 2B.

BRIEF SUMMARY OF THE INVENTION

In view of the foregoing, one embodiment of the present invention provides a spine formation device for forming a spine of a bundle of folded sheets. The spine formation device includes a sheet conveyer that conveys the bundle of folded sheets with a folded portion of the bundle forming a front end portion of the bundle, a clamping unit disposed downstream from the sheet conveyer in a sheet conveyance direction in which the bundle of folded sheets is transported, a spine forming member disposed downstream from the clamping unit in the sheet conveyance direction to flatten the folded portion of the bundle into a square spine, and a controller operatively connected to the sheet conveyer as well as the clamping unit. The clamping unit is movable in a direction of thickness of the bundle to clamp the bundle with the folded portion of the bundle projecting from a downstream end of the clamping unit in the sheet conveyance direction. The spine forming member flattens the folded portion of the bundle into a square spine. The controller causes the sheet conveyer to transport the bundle of folded sheets to a first position a predetermined distance downstream in the sheet conveyance direction from a second position at which the bundle is clamped by the clamping unit and to reverse the bundle from the first position to the second position before the clamping unit clamps the bundle.

In another embodiment, a sheet processing system includes an image forming apparatus, a sheet processing apparatus to fold a sheet, and the spine formation device described above.

Yet another embodiment provides a spine formation method used in a spine formation device including a clamping unit and a spine forming member to flatten a folded portion of a bundle of folded sheets into a square spine. The method includes a step of conveying the bundle of folded sheets with the folded portion of the bundle forming a front end portion of the bundle to a first position a predetermined distance downstream in a sheet conveyance direction from a second position at which the bundle is clamped, a step of reversing the bundle from the first position to the second position, a step of clamping the bundle from both sides in a direction of thickness of the bundle with the folded portion of the bundle projecting from a downstream end of the clamping unit in the sheet conveyance direction, and a step of flattening the folded portion of the bundle. The predetermined distance equals an amount to cancel out a difference between S1 and S2 when S1 represents a difference in length between an inner circumference and an outer circumference of the folded portion of the bundle that is not flattened by the spine forming member and S2 represents a difference in length between an inner circumference and an outer circumference of the folded portion of the bundle flattened by the spine forming member.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
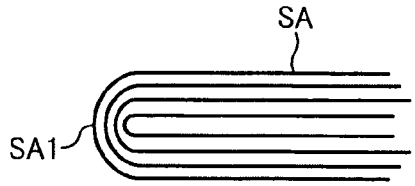
FIG. 1 RELATED ART
FIG. 1 illustrates a leading edge portion of a bundle of folded sheets that is not flattened.
Figure 2A:
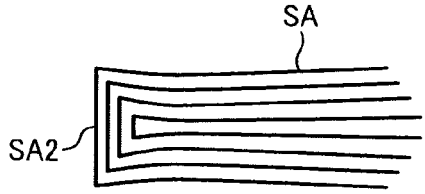
FIG. 2A RELATED ART
FIG. 2A illustrates a leading edge portion of a bundle of folded sheets flattened using a related art.
Figure 2B:
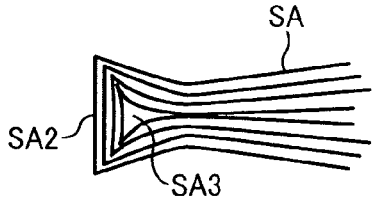
FIG. 2B RELATED ART
FIG. 2B illustrates wrinkles inside the folded portion of the bundle of folded sheets (booklet) flattened using a related art.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 3:
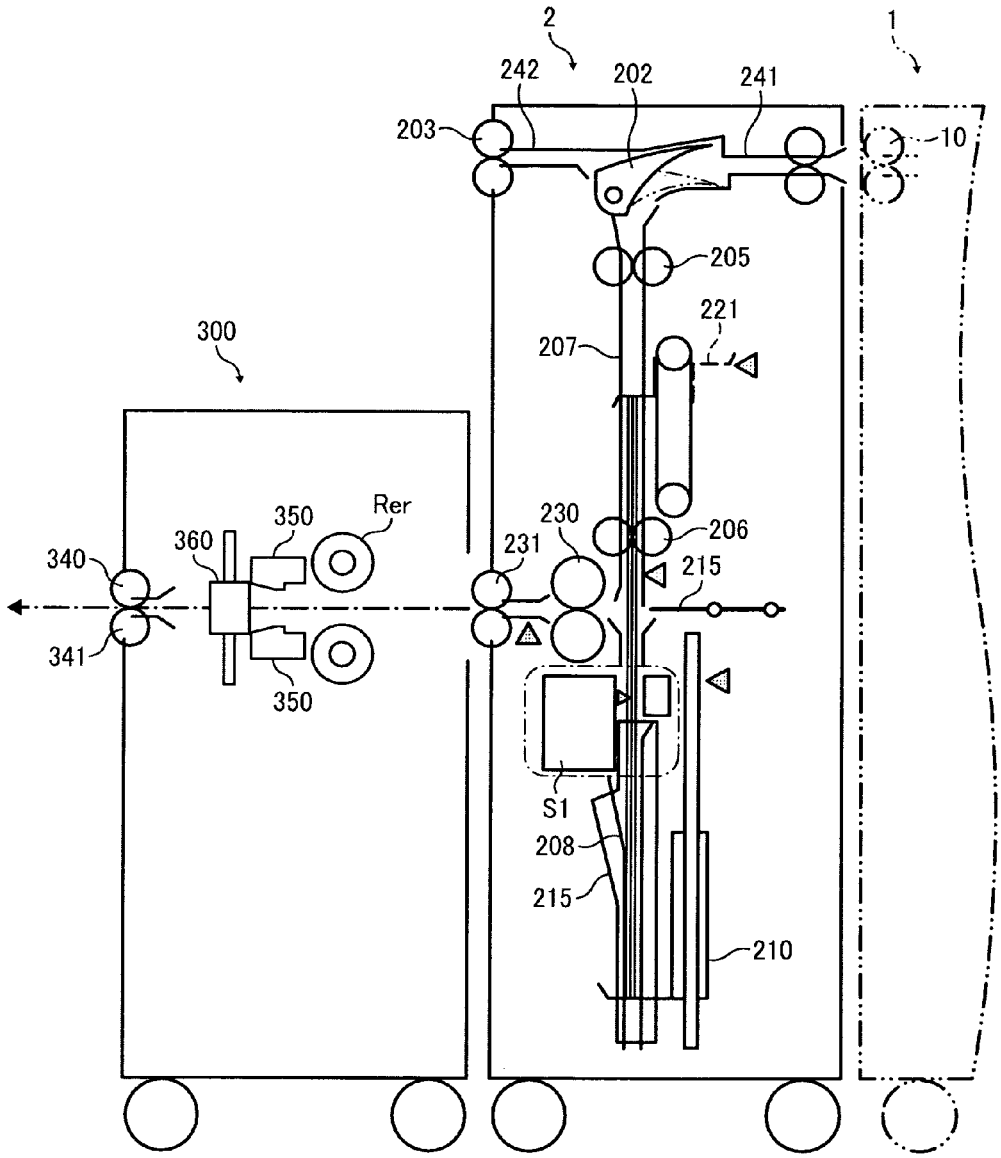
FIG. 3 illustrates a spine formation system according to an embodiment.

Referring now to the drawings, wherein like reference numerals designate identical or corresponding parts throughout the several views thereof, and particularly to FIG. 3, a spine formation device according to an embodiment of the present invention is described.

First Embodiment

FIG. 3 illustrates a spine formation device according to a first embodiment.

As shown in FIG. 3, a spine formation device 300 may be incorporated in an image forming system or sheet processing system. In the sheet processing system shown in FIG. 3, a post-processing apparatus 2 is connected to a downstream side of an image forming apparatus 1, and the spine formation device 300 is connected to a downstream side of the post-processing apparatus 2 in a direction in which a bundle of sheets is transported (hereinafter "sheet conveyance direction"). In the present embodiment, the spine formation device 300 includes a clamping unit constituted of pressure plates 350, a spine forming roller 360 serving as a spine forming member, and a pair of conveyance rollers Rer.

Before describing the first embodiment, spine formation according to a comparative example is described below with reference to FIGS. 4A through 6.

Figure 4A:
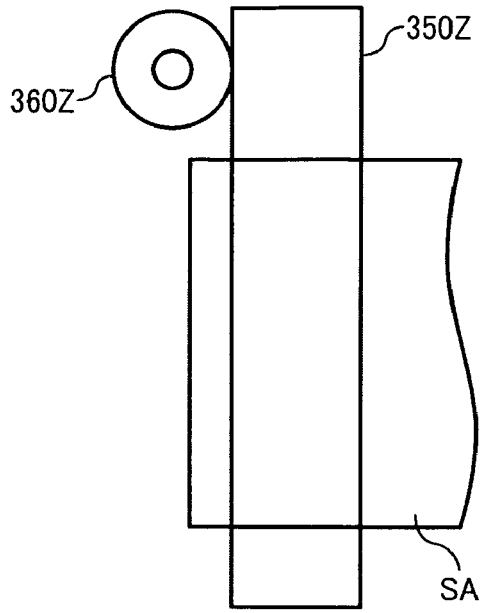
FIGS. 4A and 4B are respectively a top view and a side view illustrating the booklet transported in a comparative spine forming operation.
Figure 4B:
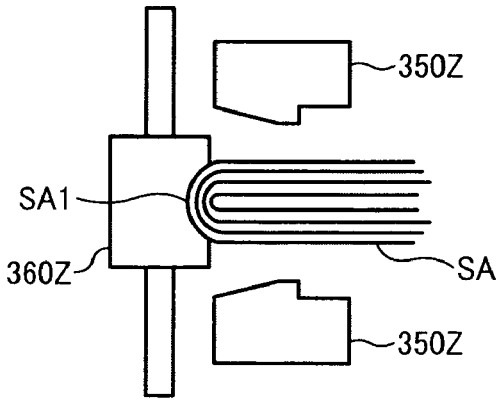

FIGS. 4A and 4B are respectively a plan view and a front view that illustrate a main portion of a comparative spine formation device.

Figure 5A:
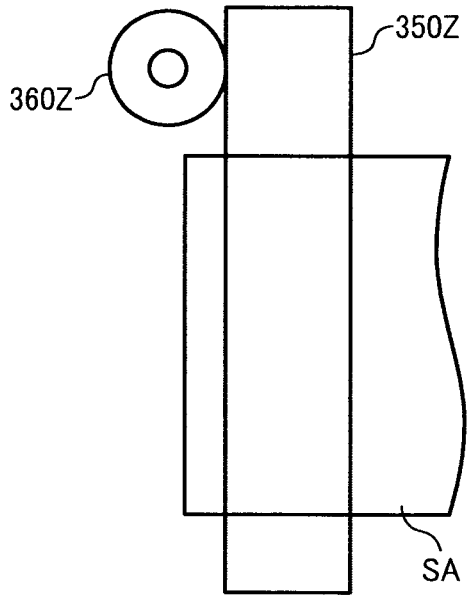
FIGS. 5A and 5B are respectively a top view and a side view illustrating the comparative spine forming operation, in which the folded portion of the booklet is clamped by a clamping unit.
Figure 5B:
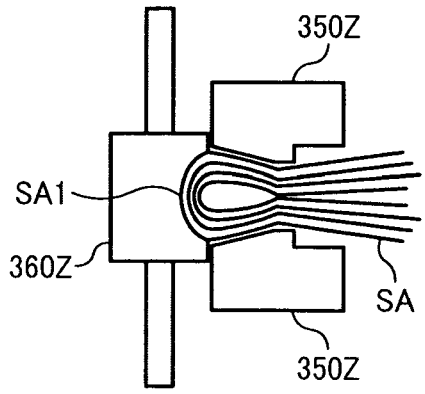
Figure 6A:
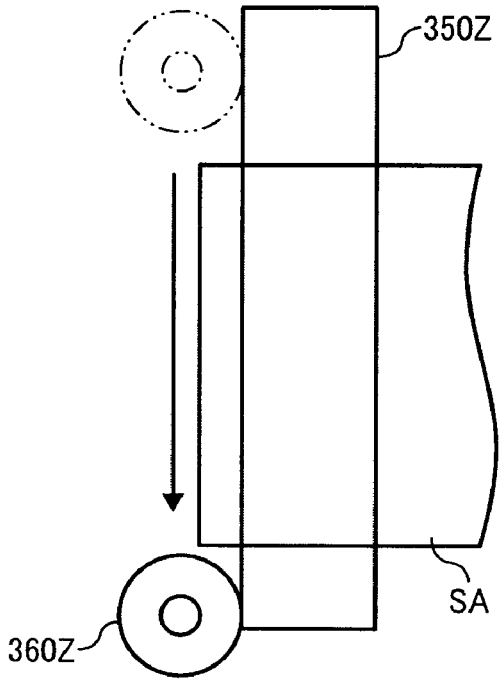
FIGS. 6A and 6B are respectively a top view and a side view illustrating the comparative spine forming operation, in which a spine forming roller flattens the folded portion of the booklet.

As shown in FIGS. 4A and 4B, the comparative spine formation device includes pressure members 350Z and a spine forming roller 360Z. The booklet SA is transported from an upstream apparatus, and, in the comparative spine formation device, the booklet SA is stopped at a spine formation position at which a folded leading edge portion SA1 projects downward beyond an upstream end of the spine forming roller 360Z in the sheet conveyance direction by an amount necessary for bulging the leading edge portion SA1 to form a flat spine SA2. Then, as shown in FIGS. 5A and 5B, the pressure members 350Z clamp the booklet SA, causing the leading edge portion SA1 to bulge. In this state, the spine forming roller 360Z rolls on the leading edge portion SA1 of the booklet SA as shown in FIG. 6A, flattening it into the square spine SA2 shown in FIG. 6B. It is to be noted that, in this specification, reference character SA represents a bundle of folded sheets (booklet), and SB represents a bundle of sheets that are not folded.

Figure 7A:
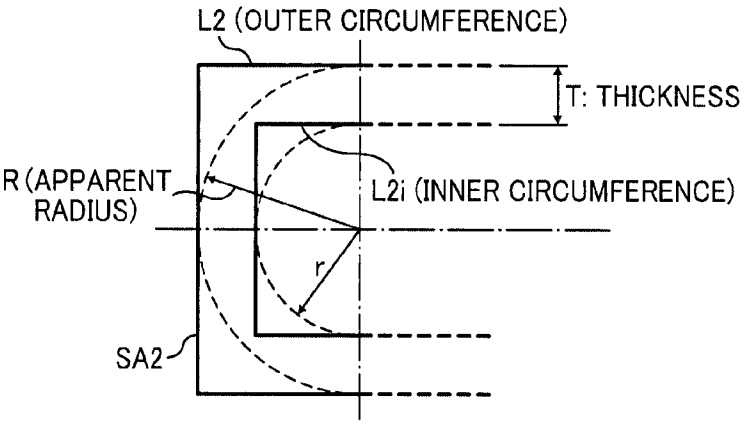
FIGS. 7A and 7B respectively illustrate the spine of the booklet after spine formation and the leading edge portion of the booklet whose leading edge portion is not flattened.
Figure 7B:
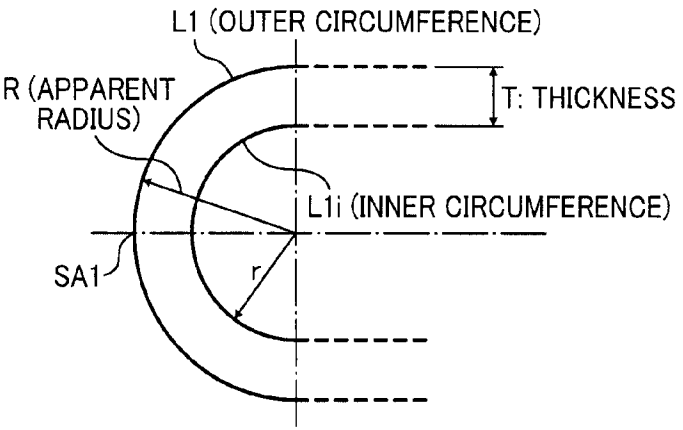

FIGS. 7A and 7B respectively illustrate the spine SA2 of the booklet SA after spine formation and the leading edge portion SA1 of the booklet whose leading edge portion is not flattened.

In FIGS. 7A and 7B, reference characters L1 and L1*i* respectively represent an outer circumferential length and an inner circumferential length of the leading edge portion SA1 of the booklet that is not flattened, L2 and L2*i* respectively represent an outer circumferential length and an inner circumferential length of the leading edge portion (spine SA2) of the booklet SA after spine formation, and T represents a thickness of the bundle that is not folded. Additionally, r and R respectively represent a radius of the inner circumference of the folded portion and the sum of the radius r and the thickness T of the bundle.

Figure 7C:
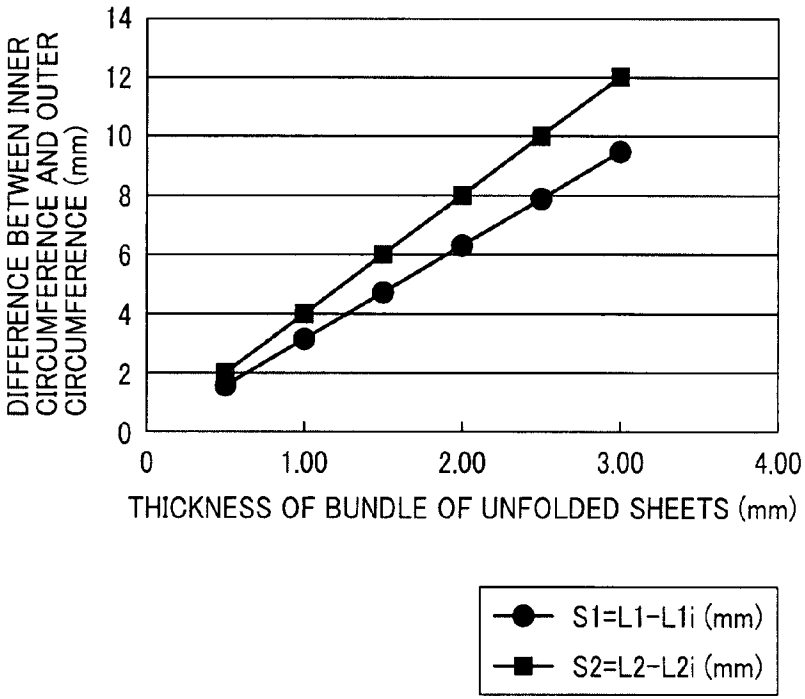
FIG. 7C is a graph that illustrates differences in length between the inner circumference and the outer circumference of the leading edge portion shown in FIG. 7B and differences in length between the inner circumference and the outer circumference of the spine shown in FIG. 7A.

FIG. 7C is a graph that illustrates a difference S1 in length between the inner circumference L1*i* and the outer circumference L1 of the leading edge portion SA1 shown in FIG. 7B that is not flattened and a difference S2 in length between the inner circumference L2*i* and the outer circumference L2 of the spine SA2 shown in FIG. 7A. The difference S1 in length between the inner circumference L1*i* and the outer circumference L1 of the leading edge portion SA1 (hereinafter also "circumferential difference S1") can be expressed by the following formula:

$$S1=(\pi\times R)-(\pi\times r)=\pi\times T$$

For example, when folded, a booklet SB (unfolded sheets) having a thickness of 3 mm becomes a booklet SA having a thickness of 6 mm. In this case, the circumferential difference S1 of the leading edge portion SA1 is 9.42 mm.

By contrast, the difference S2 between the inner circumference L2*i* and the outer circumference L2 of the square spine SA2, shown in FIG. 7A, of the booklet SA after spine formation (hereinafter also "circumferential difference S2") can be expressed as follows:

$$S2=(4\times R)-(4\times r)=4\times T$$

When the conditions are the same, the circumferential difference S2 is 12 mm.

Figure 6B:
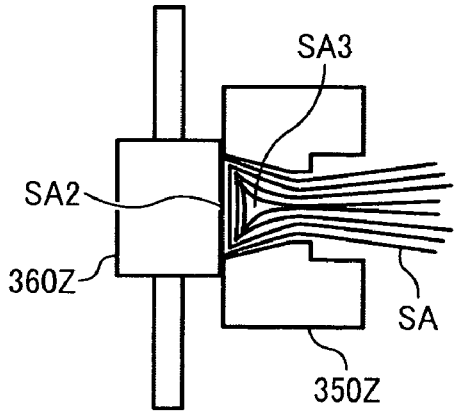

In other words, the difference between the inner circumference and the outer circumference is different by 2.58 mm depending on whether or not spine formation is performed. The difference of 2.58 mm becomes a surplus inside the folded portion when the spine SA2 is formed by the spine forming roller 360Z rolling on the leading edge portion SA1 as shown in FIGS. 6A and 6B, resulting in the wrinkles SA3 shown in FIG. 6B. Referring to FIG. 7C, the difference increases as the thickness of the bundle of sheets increases. Creation of wrinkles is inevitable in the process shown in FIGS. 4A through 6B.

In view of the foregoing, it is preferred to reduce bulging of booklets efficiently while reducing wrinkles of sheets, damage to the booklet, and the energy consumption.

In an aspect of the present invention, during spine formation, the difference between the inner circumference and the outer circumference of the booklet is adjusted to inhibit the sheets from wrinkling inside the folded portion.

More specifically, in the present embodiment, before the pressure plates 350 (i.e., clamping unit) clamp the booklet SA in spine formation, the circumferential difference S1 is adjusted to the circumferential difference S2 of the square spine SA2, thereby eliminating the extra length created inside the folded portion.

Table 1 shown below illustrates the relation between the thickness of the booklet and the extra length (S2–S1) to be eliminated.

TABLE 1

| THICKNESS 2T OF BOOKLET (mm) | THICKNESS T OF UNFOLDED SHEETS (mm) | S2 – S1 (mm) |
|---|---|---|
| 1.00 | 0.50 | 0.43 |
| 2.00 | 1.00 | 0.86 |
| 3.00 | 1.50 | 1.29 |
| 4.00 | 2.00 | 1.72 |
| 5.00 | 2.50 | 2.15 |
| 6.00 | 3.00 | 2.58 |

In the present embodiment, the amount by which the leading edge of the booklet projects (hereinafter "projection amount") is adjusted to eliminate the extra length (S2–S1). More specifically, driving of the pair of conveyance rollers Rer positioned upstream from the clamping unit (pressure plates 350) is controlled so that the pair of conveyance rollers Rer rotates in reverse immediately before spine formation. With this operation, the leading edge portion SA1 of the booklet SA is transported in reverse a predetermined distance, increasing the above-described circumferential difference.

A principle of this operation is described below with reference to FIG. 8.

Figure 8:
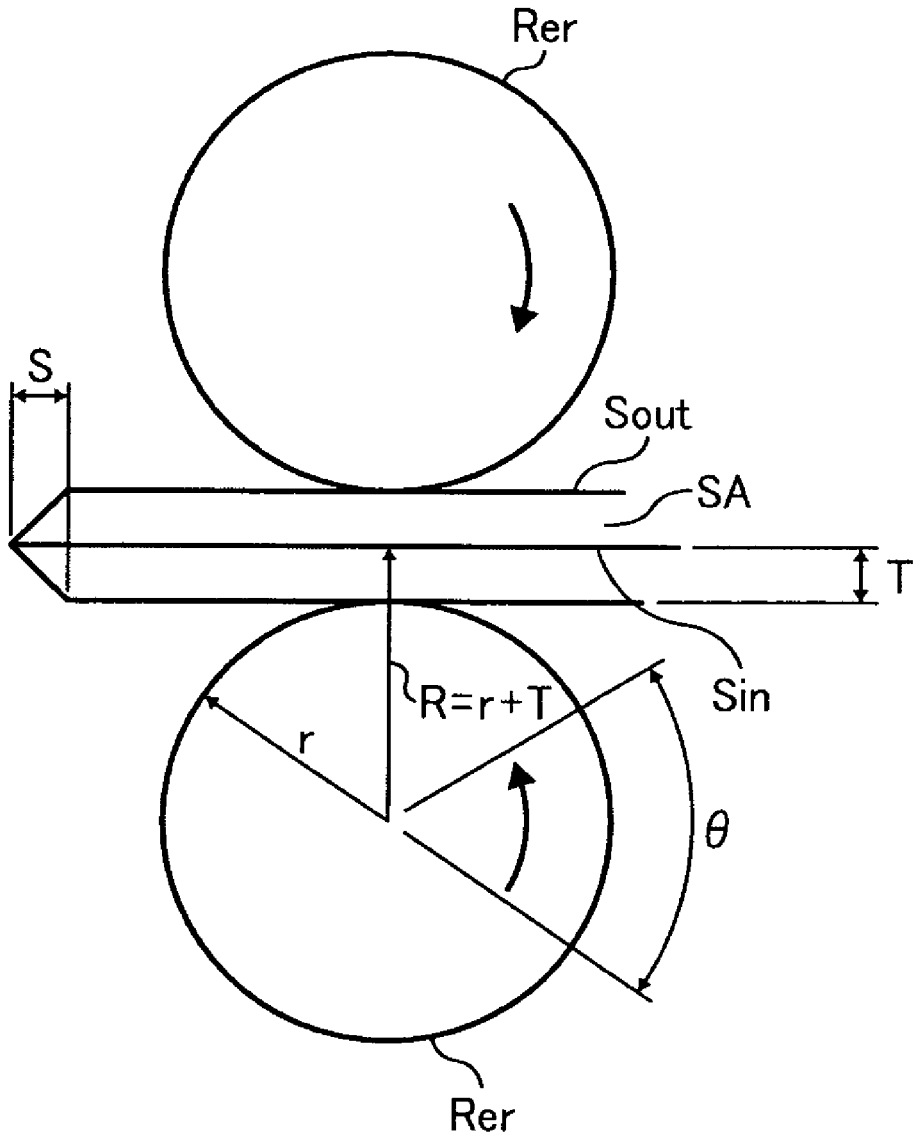
FIG. 8 illustrates a principle of creation of wrinkles inside the spine of the booklet.

As shown in FIG. 8, an outer sheet Sout of the booklet SA is transported by the amount by which the radius r of the conveyance roller Rer rotates, whereas an inner sheet Sin of the booklet SA is transported by the amount by which the apparent radius R (r+T) of the conveyance roller Rer rotates. It is to be noted that reference character T represents the thickness of the bundle SB (unfolded sheets), and hereinafter reference character T2 represents the thickness of the folded booklet SA. That is, when the conveyance rollers Rer keep transporting the booklet SA in the state shown in FIG. 8, the amount by which the inner sheet Sin is transported (hereinafter "conveyance amount") becomes greater than the conveyance amount of the outer sheet Sout gradually.

When the difference between the folded leading edge of the inner sheet Sin and the folded leading edge of the outer sheet Sout is referred to as a center projection amount S, the center projection amount S of the booklet SA having a thickness T2 of 6 mm (the bundle SB having a thickness T of 3 mm) is 2.58 mm as described above. When this is converted into a rotational angle θ, θ=49.18°.

Table 2 shows the thickness T2 of the booklet SA, the center projection amount S, and the rotational angle θ of the conveyance roller Rer calculated when the thickness of the bundle SB is 1 mm, 2 mm, 3 mm, 4 mm, and 5 mm.

TABLE 2

| THICKNESS 2T OF BOOKLET (mm) | THICKNESS T OF UNFOLDED SHEETS (mm) | CENTER PROJECTION AMOUNT S (mm) | ANGLE θ |
|---|---|---|---|
| 1.00 | 0.50 | 0.43 | 49.18 |
| 2.00 | 1.00 | 0.86 | 49.18 |
| 3.00 | 1.50 | 1.29 | 49.18 |
| 4.00 | 2.00 | 1.72 | 49.18 |
| 5.00 | 2.50 | 2.15 | 49.18 |
| 6.00 | 3.00 | 2.58 | 49.18 |

From Table 2, it can be known that the rotational angle θ of the conveyance roller Rer corresponding to the center projection amount S is 49.18° regardless of the thickness T of the bundle SB. In other words, the center projection amount S is dependent on the thickness T of the bundle SB and the thickness T2 of the booklet SA, and the extra length (S2−S1) is dependent on the circumferential difference. Therefore, the extra length equals the center projection amount S.

$$S=(S2-S1)\text{ mm}$$

Consequently, when the center projection amount S is zero, the extra length is not created inside the folded portion of the booklet SA. It means that, in theory, transporting the booklet SA in the direction reverse to the folded side can eliminate the extra length created inside the folded portion of the booklet SA preliminarily.

Operation of the spine formation device 300 according to the present embodiment is described below with reference to FIGS. 9A through 9G.

FIGS. 9A through 9G are front views illustrating a main portion of the spine formation device 300 and correspond to FIGS. 4A through 6B.

In the spine formation mechanism shown in FIGS. 9A through 9G, the pair of conveyance rollers Rer are added to the comparative configuration shown in FIGS. 4A through 6B.

The conveyance rollers Rer are disposed upstream from the pressure plates 350 in the sheet conveyance direction, and the spine forming roller 360 is disposed downstream from the pressure plates 350 in that direction. These components are driven by respective driving mechanisms. A control configuration is described later with reference to FIG. 28. The conveyance rollers Rer can transport the booklet SA and stop it at given positions. The conveyance rollers Rer initially stops the booklet SA at a position (first position) downstream from the spine formation position (second position) and reverses the booklet SA to the second position.

Figure 28:
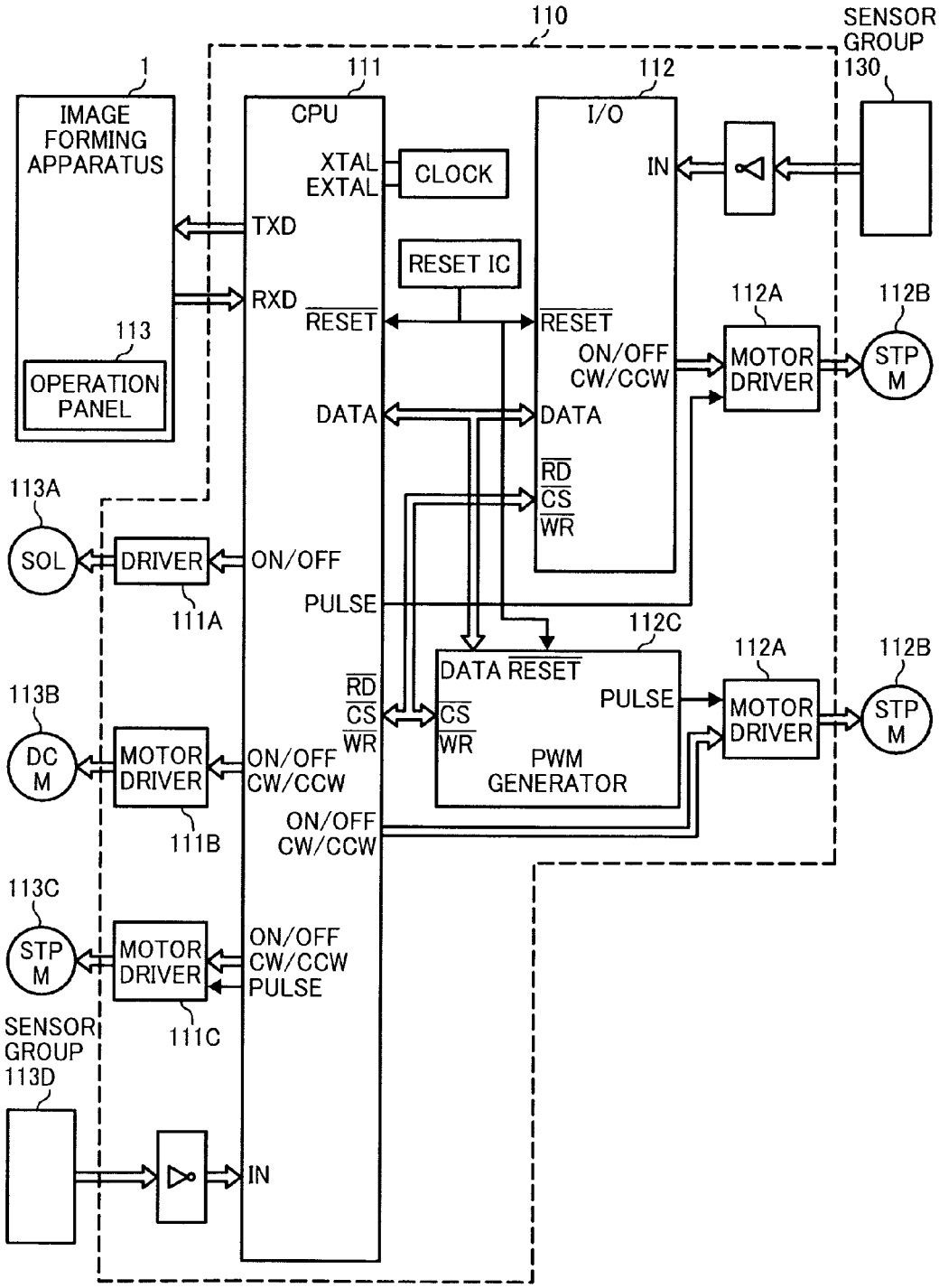
FIG. 28 is a block diagram illustrating circuitry of a control circuit of the sheet processing system.

More specifically, a control circuit 110 shown in FIG. 28 of the spine formation device 300 or the image forming system including it calculates the above-described amount necessary for forming the spine SA2 of the booklet SA and the extra length (S2-S1) created inside the folded portion. The extra length equals the center projection amount S, that is, the amount by which the booklet SA is transported in reverse.

Figure 9A:
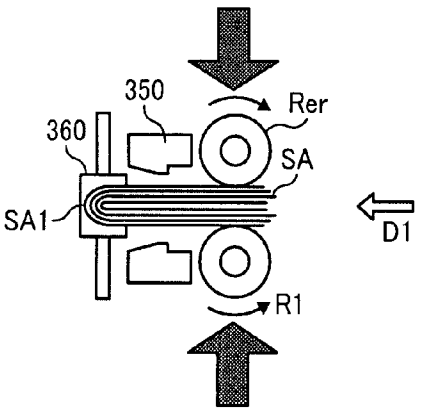
FIGS. 9A through 9G illustrate spine formation to prevent creation of wrinkles inside the spine of the booklet.
Figure 9B:
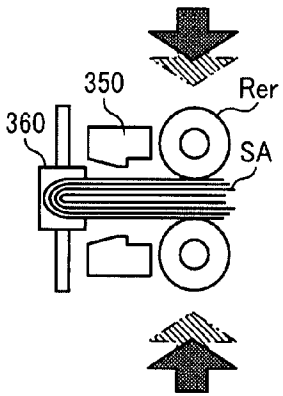
Figure 9C:
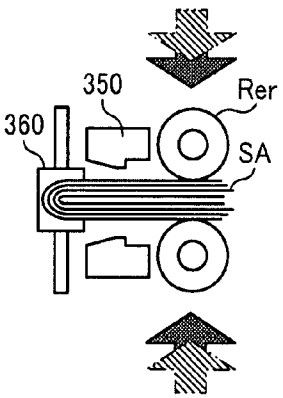

Referring to FIG. 9A, the conveyance rollers Rer transport the booklet SA in the direction indicated by arrow D1 to the first position, which is downstream from a position where the booklet SA contacts the upstream edge of the spine forming roller 360 in the sheet conveyance direction by the sum of the center projection amount S and the amount necessary for forming the spine. In FIG. 9B, the conveyance rollers Rer stop the booklet SA at the first position. Subsequently, as shown in FIG. 9C, the control circuit 110 (shown in FIG. 28) reduces the pressure between the conveyance rollers Rer, thereby reducing the projection amount of the inner sheet Sin. Then, the pressure between the conveyance rollers Rer is again increased. The reduction in pressure between the conveyance rollers Rer to adjust the projection amount of the inner sheet Sin is within an extent that no gaps are created between sheets.

Figure 9D:
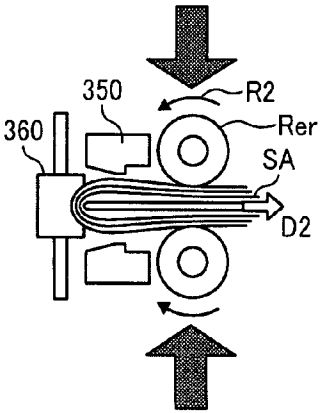
Figure 9E:
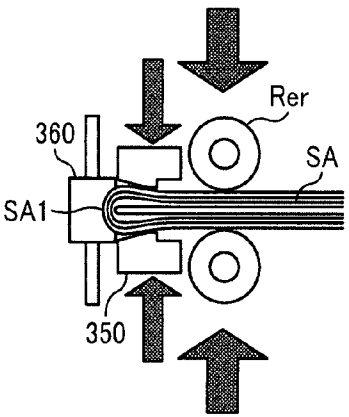

Subsequently, as shown in FIG. 9D, the control circuit 110 causes the conveyance rollers Rer to rotate in reverse as indicated by arrow R2 to transport the booklet SA in reverse as indicated by arrow D2 by the center projection amount S to cancel out the extra length (S2−S1). Then, as shown in FIG. 9E, the pressure plates 350 clamp the leading edge portion SA1 of the booklet SA. It is to be noted that the position to which the booklet SA is reversed is the spine formation position because, in FIG. 9A, the booklet SA is transported to the first position downstream from the contact position between the booklet SA and the spine forming roller 360 (i.e., upstream end of the spine forming roller 360) by the sum of the center projection amount S and the mount necessary for forming the spine.

Figure 9F:
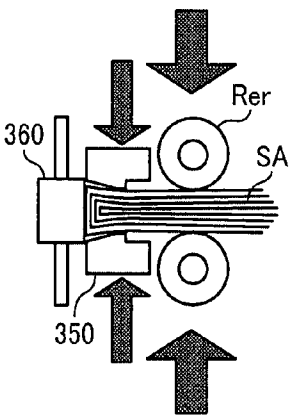
Figure 9G:
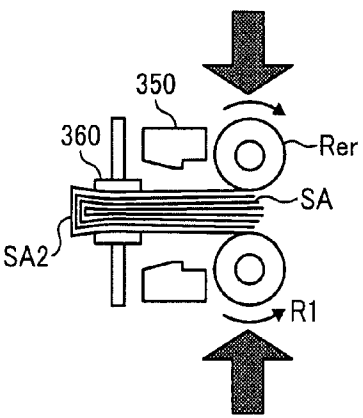

In this state, as shown in FIG. 9F, the spine forming roller 360 rolls on the leading edge portion SA1 of the booklet SA (in the direction perpendicular to the surface of the paper on which FIG. 9F is drawn) and applies pressure to the leading edge portion SA1 in the direction indicated by arrow D2 in FIG. 9D. In this process, the folded leading edge portion SA1 of the booklet SA is shaped into a flat spine SA2. After spine formation, in FIG. 9G, the pressure between the pressure plates 350 is reduced and the booklet SA is released. The conveyance rollers Rer transport the booklet SA downstream as indicated by arrow R1, and then the book SA is discharged.

Thus, the flat spine SA2 can be formed, reducing the thickness of the folded sheets. At that time, because the center projection amount S is reduced to zero as described above, no wrinkles SA3 are created inside the booklet SA, producing high-quality spines.

Second Embodiment

Figure 10:
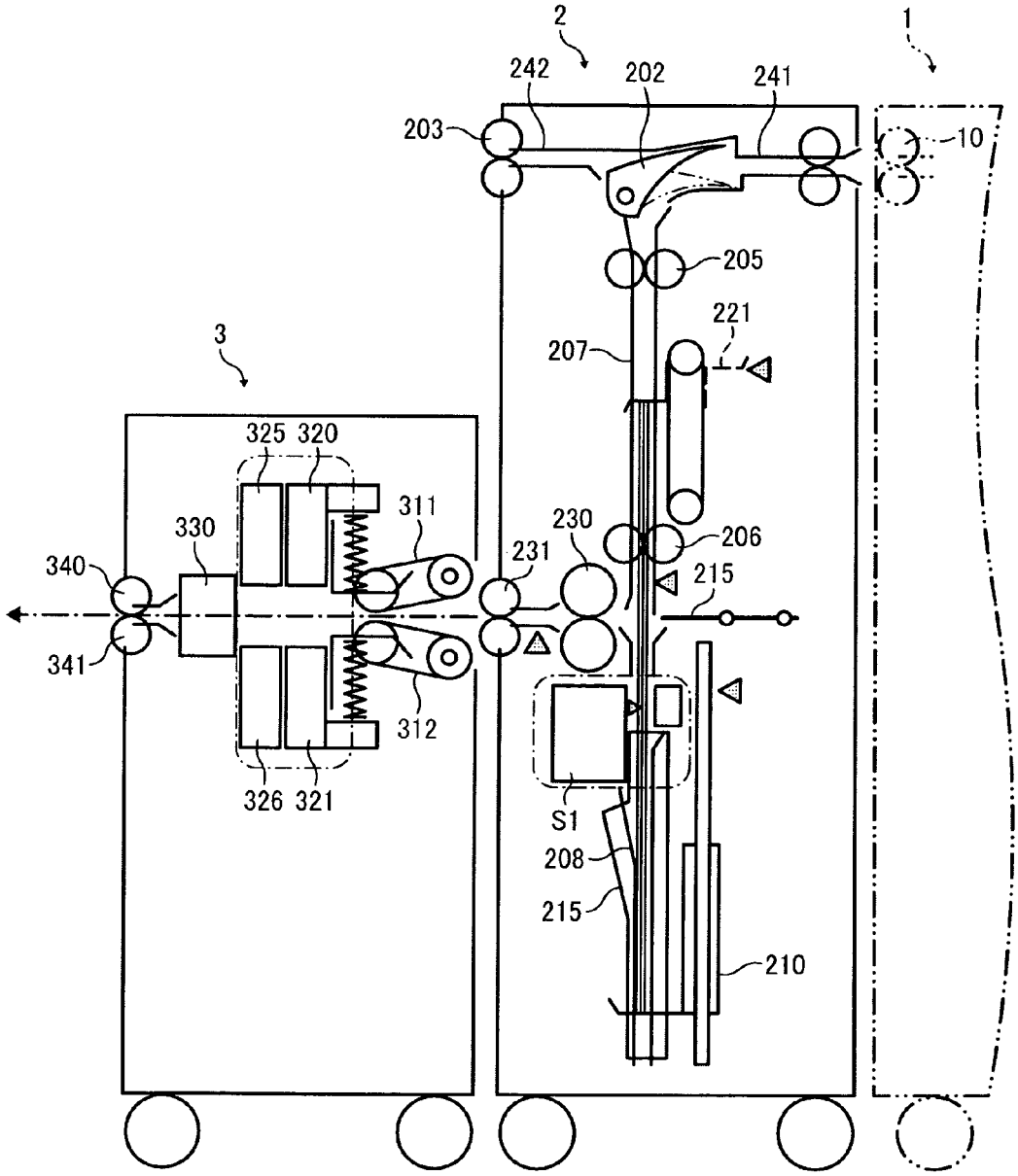
FIG. 10 illustrates a spine formation system including a post-processing apparatus and a spine formation device according to an embodiment of the present invention.

FIG. 10 illustrates a sheet processing system including a post-processing apparatus 2 and a spine formation device 3 according to a second embodiment of the present invention.

In this system, the post-processing apparatus 2 performs saddle-stitching or saddle-stapling, that is, stitches or staples, along its centerline, a bundle of sheets discharged thereto by a pair of discharge rollers 10 from the image forming apparatus 1 and then folds the bundle of sheets along the centerline, after which a pair of discharge rollers 231 transports the bundle of folded sheets (booklet) to the spine formation device 3. Then, the spine formation device 3 flattens the folded portion of the booklet and discharges it outside the spine formation device 3.

The image forming apparatus 1 may be a copier, a printer, a facsimile machine, or a multifunction machine including at least two of those functions that forms images on sheets of recording media based on image data input by users or read by an image reading unit. The spine formation device 3 includes conveyance belts 311 and 312 (conveyance unit 31), auxiliary pressure plates 320 and 321, pressure plates 325 and 326, a contact plate 330 (spine forming member), and discharge rollers 340 and 341 (discharge unit) disposed in that order in the sheet conveyance direction. The auxiliary pressure plates 320 and 321 and the pressure plates 325 and 326 together form a clamping unit.

Figure 11:
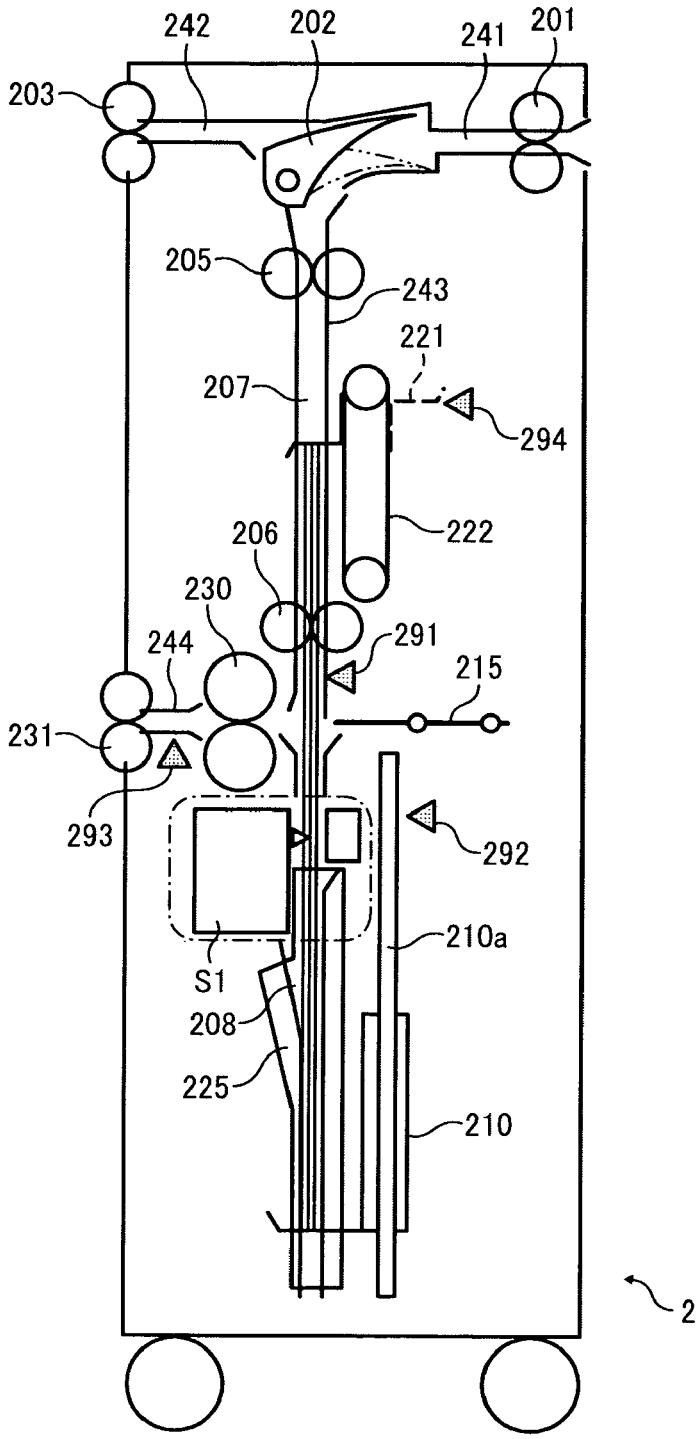
FIG. 11 is a front view illustrating a configuration of the post-processing apparatus shown in FIG. 10.

FIG. 11 illustrates a configuration of the post-processing apparatus 2 shown in FIG. 10.

Referring to FIG. 11, an entrance path 241, a sheet path 242, and a center-folding path 243 are formed in the post-processing apparatus 2. A pair of entrance rollers 201 provided extreme upstream in the entrance path 241 in the sheet conveyance direction receives a bundle of aligned sheets transported by the discharge rollers 10 of the image forming apparatus 1. It is to be noted that hereinafter "upstream" and "downstream" refer to those in the sheet conveyance direction unless otherwise specified.

A separation pawl 202 is provided downstream from the entrance rollers 201 in the entrance path 241. The separation pawl 202 extends horizontally in the drawings and switches the sheet conveyance direction between a direction toward the sheet path 242 and that toward the center-folding path 243. The sheet path 242 extends horizontally from the entrance path 241 and guides the bundle of sheets to a downstream device or a discharge tray, not shown, and a pair of upper discharge rollers 203 discharges the bundle of sheets from the sheet path 242. The center-folding path 243 extends vertically in the drawings from the separation pawl 202, and the bundle of sheets is transported along the folding path 243 when at least one of stapling and folding is performed.

Along the center-folding path 243, an upper sheet guide 207 and a lower sheet guide 208 to guide the bundle of sheets are provided above and beneath a folding plate 215, respectively, and the folding plate 215 is used to fold the bundle of sheets along its centerline. A pair of upper transport rollers 205, a trailing-edge alignment pawl 221, and a pair of lower transport rollers 206 are provided along the upper sheet guide 207 in that order from the top in FIG. 11. The trailing-edge alignment pawl 221 is attached to a pawl driving belt 222 driven by a driving motor, not shown, and extends perpendicularly to a surface of the driving belt 222. As the pawl driving belt 222 rotates opposite directions alternately, the trailing-edge alignment pawl 221 pushes a trailing-edge of the bundle of sheets toward a movable fence 210 disposed in a lower portion in FIG. 11, thus aligning the bundle of sheets. Additionally, the trailing-edge pawl 221 moves away from the upper sheet guide 207 as indicated by broken lines shown in FIG. 11 when the bundle of sheets enters the center-folding path 243 and when the bundle of sheets ascends to be folded. It is to be noted that, in FIG. 11, reference numeral 294 represents a pawl home position (HP) detector that detects the trailing-edge alignment pawl 221 at a home position away from the center-folding path 243, indicated by the broken lines shown in FIG. 11. The trailing-edge alignment pawl 221 is controlled with reference to the home position.

A saddle stapler S1, a pair of jogger fences 225, and the movable fence 210 are provided along the lower sheet guide 208 in that order from the top in FIG. 11. The lower sheet guide 208 receives the bundle of sheets guided by the upper sheet guide 207, and the pair of jogger fences 225 extends in a sheet width direction perpendicular to the sheet conveyance direction. The movable fence 210 positioned beneath the lower sheet guide 208 moves vertically, and a leading edge of the bundle of sheets contacts the movable fence 210.

The saddle stapler S1 staples the bundle of sheets along its centerline. While supporting the leading edge of the bundle of sheets, the movable fence 210 moves vertically, thus positioning a center portion of the bundle of sheets at a position facing the saddle stapler S1, where saddle stapling is performed. The movable fence 210 is supported by a fence driving mechanism 210*a* and can move from the position of a fence HP detector 292 disposed above the stapler S1 to a bottom position in the post-processing apparatus 2 in FIG. 11. A movable range of the movable fence 210 that contacts the leading edge of the bundle of sheets is set so that strokes of the movable fence 210 can align sheets of any size processed by the post-processing apparatus 2. It is to be noted that, for example, a rack-and-pinion may be used as the fence driving mechanism 210*a*.

The folding plate 215, a pair of folding rollers 230, and a discharge path 244, and the pair of lower discharge rollers 231 are provided horizontally between the upper sheet guide 207 and the lower sheet guide 208, that is, in a center portion of the center-folding path 243 in FIG. 11. The folding plate 215 can move reciprocally back and forth horizontally in the drawing in the folding operation, and the folding plate 215 is aligned with a position where the folding rollers 230 press against each other (hereinafter "nip") in that direction. The discharge path 244 is positioned also on an extension line from the line connecting them. The lower discharge rollers 231 are disposed extreme downstream in the discharge path 244 and discharge the bundle of folded sheets to a subsequent stage.

Additionally, a sheet detector 291 provided on a lower side of the upper sheet guide 207 in FIG. 11 detects the leading edge of the bundle of sheets that passes a position facing the folding plate 215*a* (hereinafter "folding position") in the center-folding path 243. Further, a folded portion detector 293 provided along the discharge path 224 detects the folded leading-edge portion (hereinafter simply "folded portion") of the bundle of folded sheets, thereby recognizes the passage of the bundle of folded sheets.

Saddle-stapling and center-folding performed by the post-processing apparatus 2 shown in FIG. 10 are described briefly below with reference to FIGS. 12 through 16.

Figure 12:
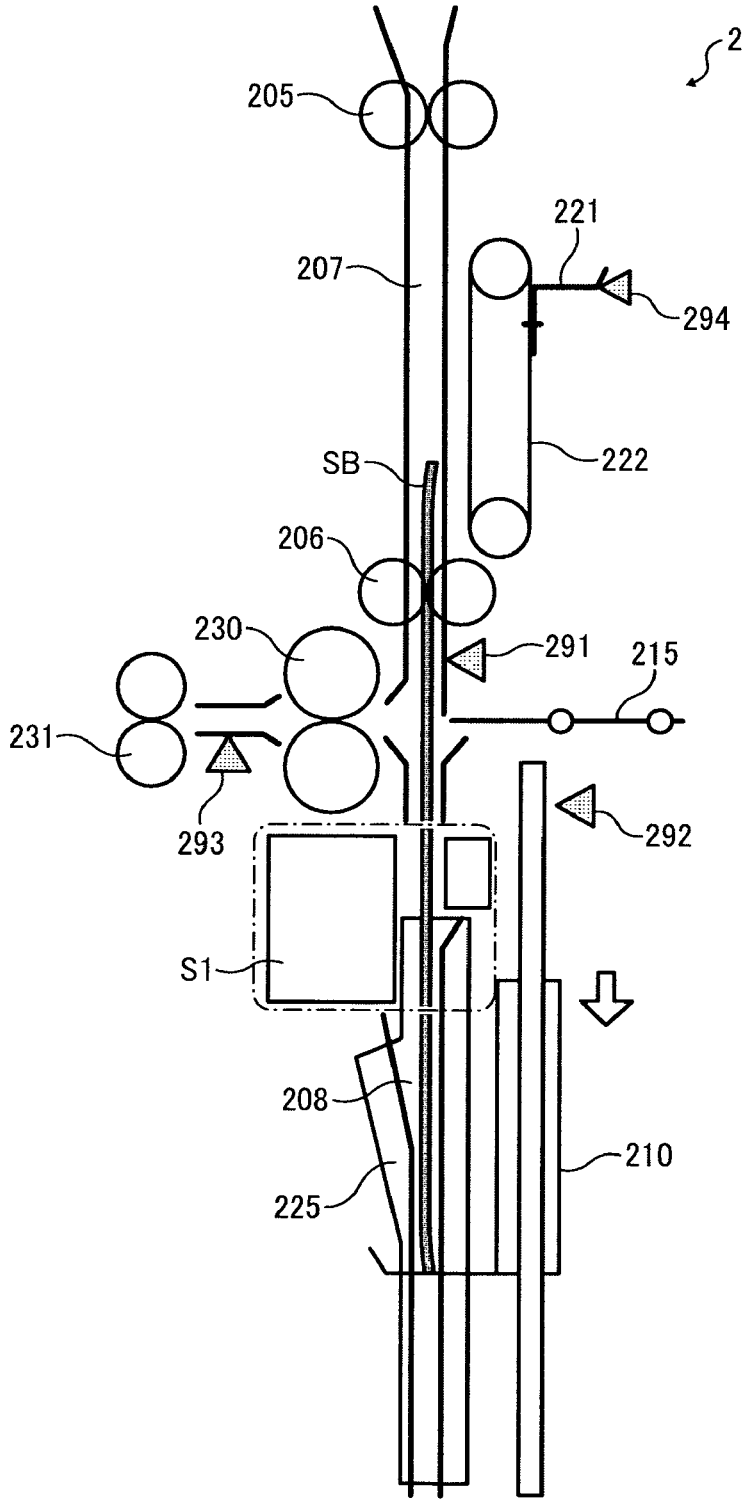
FIG. 12 illustrates the post-processing apparatus in which a bundle of sheets is transported.

When a user selects saddle-stapling and center-folding via an operation panel 113 (shown in FIG. 28) of the image forming apparatus 1, the separation pawl 202 pivots counter-clockwise in FIG. 12, thereby guiding the bundle of sheets to be stapled and folded to the center-folding path 243. The separation pawl 202 is driven by a solenoid, not shown. Alternatively, the separation pawl 202 may be driven by a motor.

A bundle of sheets SB transported to the center-folding path 243 is transported by pair of entrance rollers 201 and the pair of upper transport rollers 205 downward in the center-folding path 243 in FIG. 3. After the sheet detector 291 detects the passage of the bundle of sheets SB, the lower transport rollers 206 transport the bundle of sheets SB until the leading edge of the bundle of sheets SB contacts the movable fence 210 as shown in FIG. 12. At that time, the movable fence 210 is at a standby position varied in the vertical direction shown in FIG. 3 according to sheet size data, that is, sheet size data in the sheet conveyance direction, transmitted from the image forming apparatus 1 shown in FIG. 1. Simultaneously, the lower transport rollers 206 sandwich the bundle of sheets SB therebetween, and the trailing-edge alignment pawl 221 is at the home position.

Figure 13:
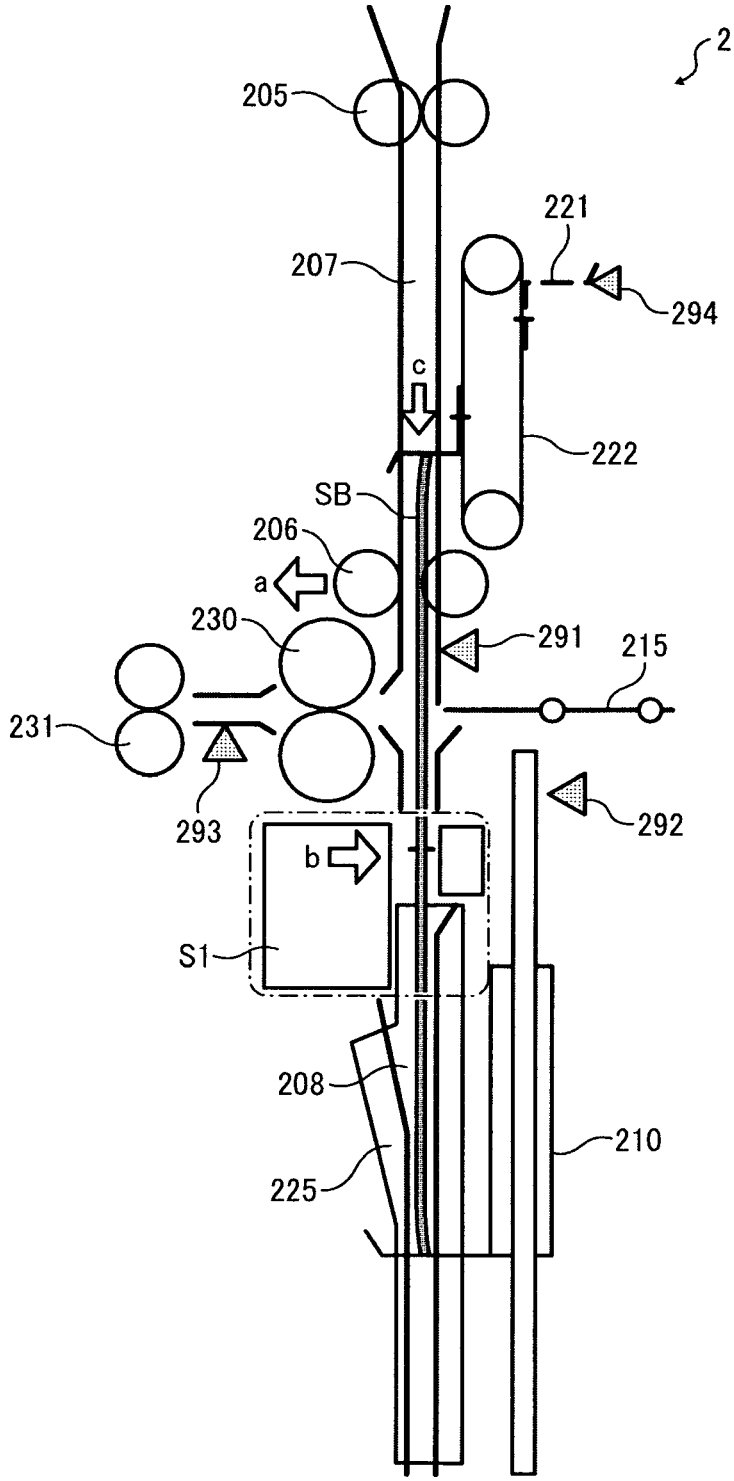
FIG. 13 illustrates stapling of bundle of sheets along the centerline in the post-processing apparatus.

Referring to FIG. 13, when the pair of lower transport rollers 206 is moved away from each other as indicated by arrow a shown in FIG. 13, releasing the trailing edge of the bundle SB whose leading edge is in contact with the movable fence 210, the trailing-edge alignment pawl 221 is driven to push the trailing edge of the bundle SB, thus completing alignment of the bundle of sheets SB in the sheet conveyance direction indicated by arrow a.

Subsequently, the bundle of sheets SB is aligned in the sheet width direction perpendicular to the sheet conveyance direction by the pair of jogger fences 225, and thus alignment of the bundle of sheets SB in both the sheet width direction and the sheet conveyance direction is completed. At that time, the amounts by which the trailing-edge alignment pawl 221 and the pair of jogger fences 225 push the bundle of sheets SB to align it are set to optimum values according to the sheet size, the number of sheets, and the thickness of the bundle.

It is to be noted that, when the bundle of sheets SB is relatively thick, it occupies a larger area in the center-folding path 243 with the remaining space therein reduced, and accordingly a single alignment operation is often insufficient to align it. Therefore, the number of alignment operations is increased in that case. Thus, the bundle of sheets SB can be aligned fully. Additionally, as the number of sheets increases, it takes longer to stack multiple sheets one on another upstream from the post-processing apparatus 2, and accordingly it takes longer before the post-processing apparatus 2 receives a subsequent bundle of sheets. Consequently, the increase in the number of alignment operations does not cause a loss time in the sheet processing system, and thus efficient and reliable alignment can be attained. Therefore, the number of alignment operations may be adjusted according to the time required for the upstream processing.

It is to be noted that the standby position of the movable fence 210 is typically positioned facing the saddle-stapling position of the bundle of sheets SB or the stapling position of the saddle stapler S1. When aligned at that position, the bundle of sheets SB can be stapled at that position without moving the movable fence 210 to the saddle-stapling position of bundle of sheets SB. Therefore, at that standby position, a stitcher, not shown, of the saddle stapler S1 is driven in a direction indicated by arrow b shown in FIG. 13, and thus the bundle of sheets SB is stapled between the stitcher and a clincher, not shown, of the saddle stapler S1.

It is to be noted that the positions of the movable fence 210 and the trailing-edge alignment pawl 221 are controlled with pulses of the fence HP detector 292 and the pawl HP detector 294, respectively. Positioning of the movable fence 210 and the trailing-edge alignment pawl 221 is performed by a central processing unit (CPU) 111 of the control circuit 110, shown in FIG. 28, of the post-processing apparatus 2.

FIG. 28 is a block diagram schematically illustrating the control circuit 110 of the sheet processing system incorporating a micro computer including the CPU 111 and an input/output (I/O) interface 112.

In the control circuit 110, the CPU 111 performs various types of control according to signals received via the I/O interface 112 from respective switches in an operation panel 113 of the image forming apparatus 1, a sensor group 130 including various sensors and detectors. The CPU 111 reads out program codes stored in a read only memory (ROM), not shown, and performs various types of control based on the programs defined by the program codes using a random access memory (RAM), not shown, as a work area and data buffer. The control circuit 110 includes a driver 111A, motor drivers 111B, 111C, and 112A, and a pulse module width (PWM) generator 112C, and communicates with stepping motors 112B, solenoids 113A, direct current (DC) motors 113B, stepping motors 113C, and sensor groups 113D.

Figure 14:
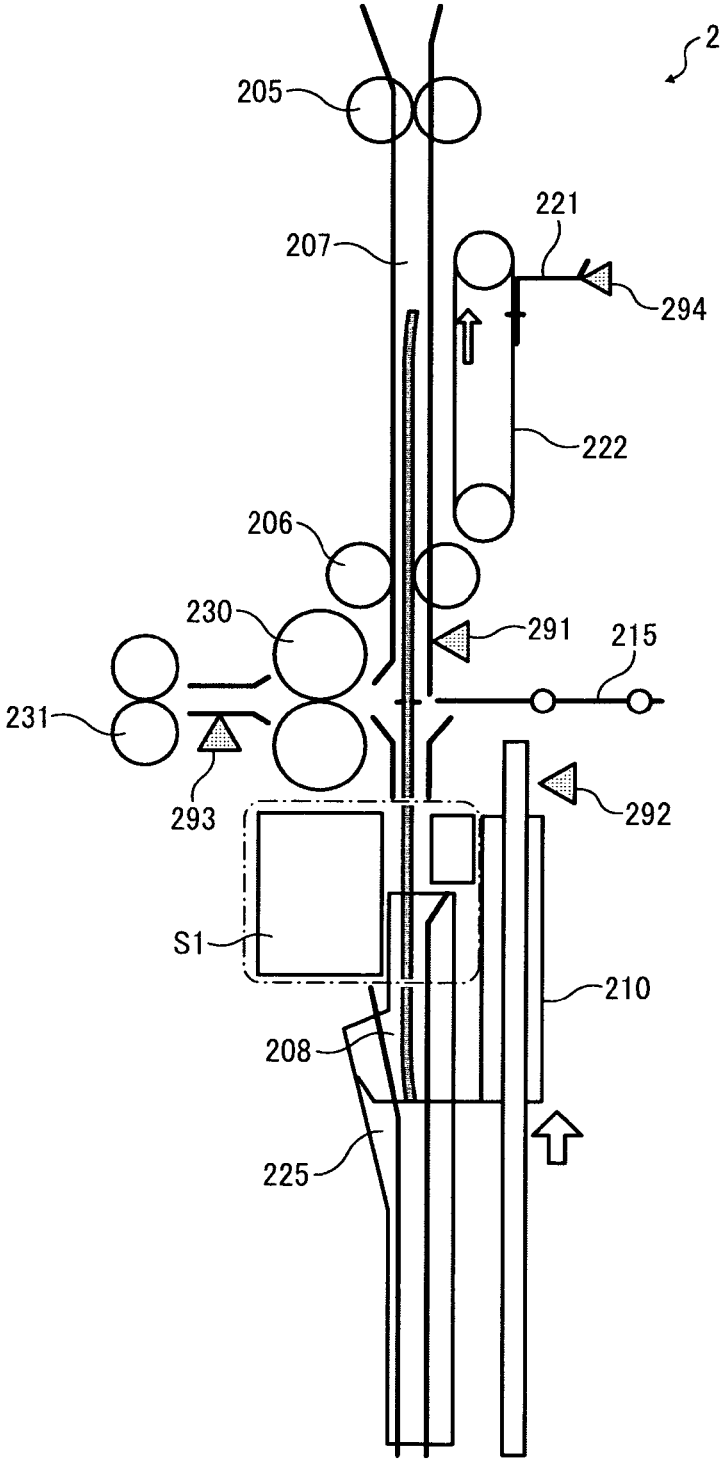
FIG. 14 illustrates the post-processing apparatus in which the bundle of sheets is set at a center-folding position.

After stapled along the centerline in the state shown in FIG. 13, the bundle of sheets SB is lifted to a position where the saddle-stapling position thereof faces the folding plate 215 as the movable fence 210 moves upward as shown in FIG. 14 while the pair of lower transport rollers 206 does not press against the bundle of sheets SB. This position is adjusted with reference to the position detected by the fence HP detector 292.

Figure 15:
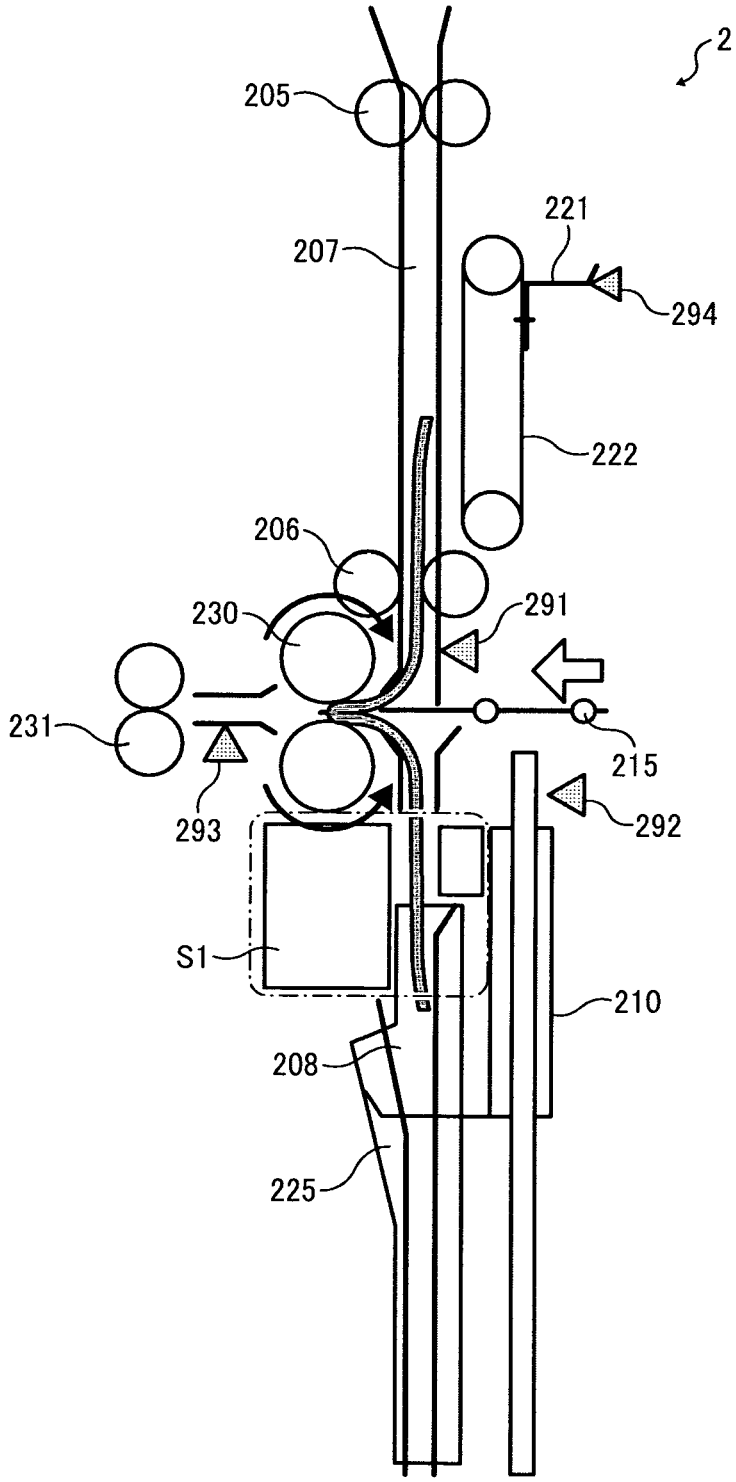
FIG. 15 illustrates the post-processing apparatus in which the bundle of sheets is being folded in two.

When the bundle of sheets SB is set at the position shown in FIG. 14, the folding plate 215 approaches the nip between the pair of folding rollers 230 as shown in FIG. 15 and pushes toward the nip the bundle of sheets SB in a portion around the staples binding the bundle in a direction perpendicular or substantially perpendicular to a surface of the bundle of sheets SB. Thus, the bundle of sheets SB pushed by the folding plate 215 is folded in two and sandwiched between the pair of folding roller 230 being rotating. While squeezing the bundle of sheets SB caught in the nip, the pair of folding roller 230 transports the bundle of sheets SB. Thus, while squeezed and transported by the folding rollers 230, the bundle of sheets SB is center-folded as a booklet SB. FIG. 15 illustrates a state in which a folded leading edge of the booklet SB is squeezed in the nip between the folding rollers 230.

Figure 16:
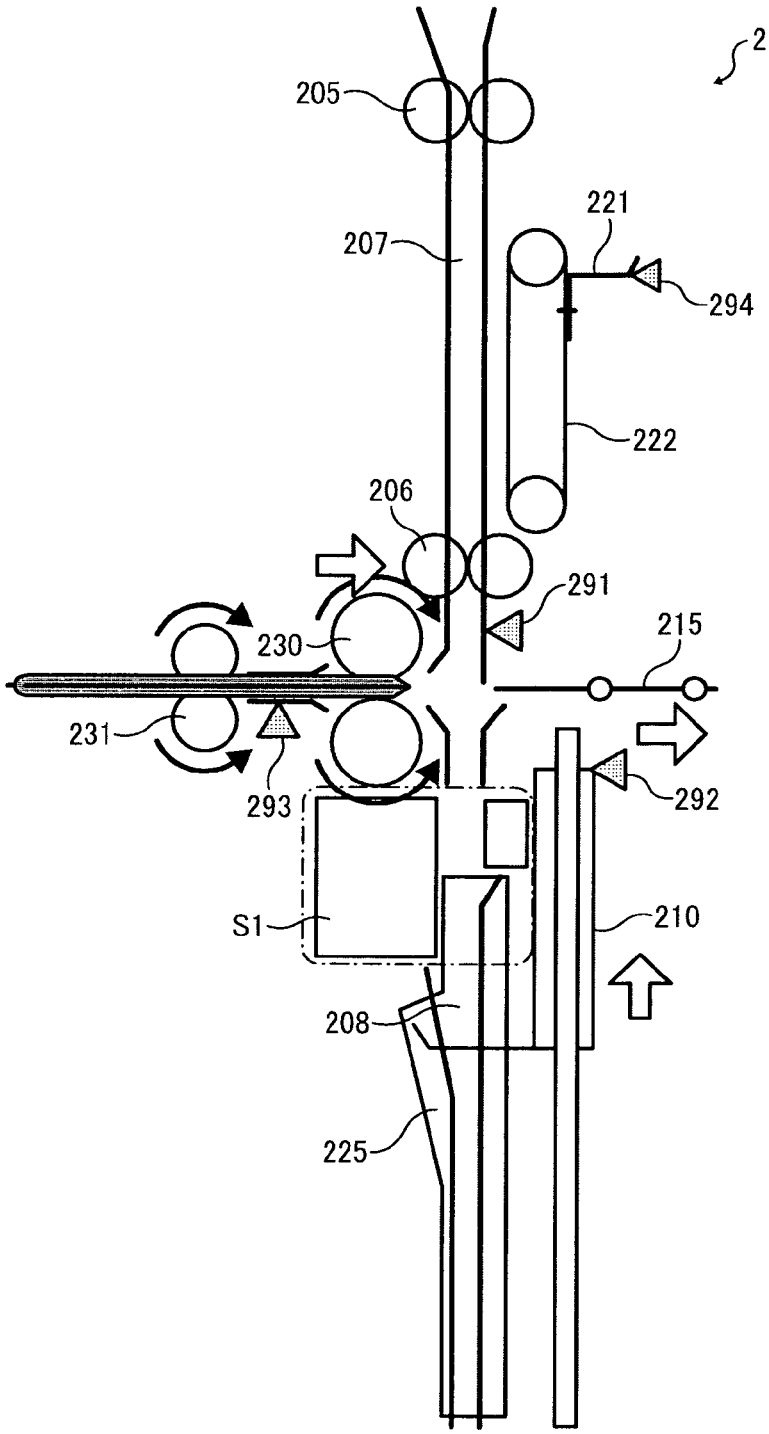
FIG. 16 illustrates the post-processing apparatus from which the bundle of folded sheets is discharged.

After folded in two, referring to FIG. 16, the booklet SB is transported by the folding rollers 230 downstream and then discharged by the discharged rollers 231 to a subsequent stage. When the folded portion detector 293 detects a trailing edge portion of the booklet SB, both the folding plate 215 and the movable fence 210 return to the respective home positions. Then, the lower transport rollers 206 move to press against each other as a preparation for receiving a subsequent bundle of sheets. Further, if the number and the size of sheets forming the subsequent bundle are similar to those of the previous bundle of sheets, the movable fence 210 may move again to the position shown in FIG. 12 and wait there. The above-described control is performed also by the CPU 111 of the control circuit 110.

Figure 17:
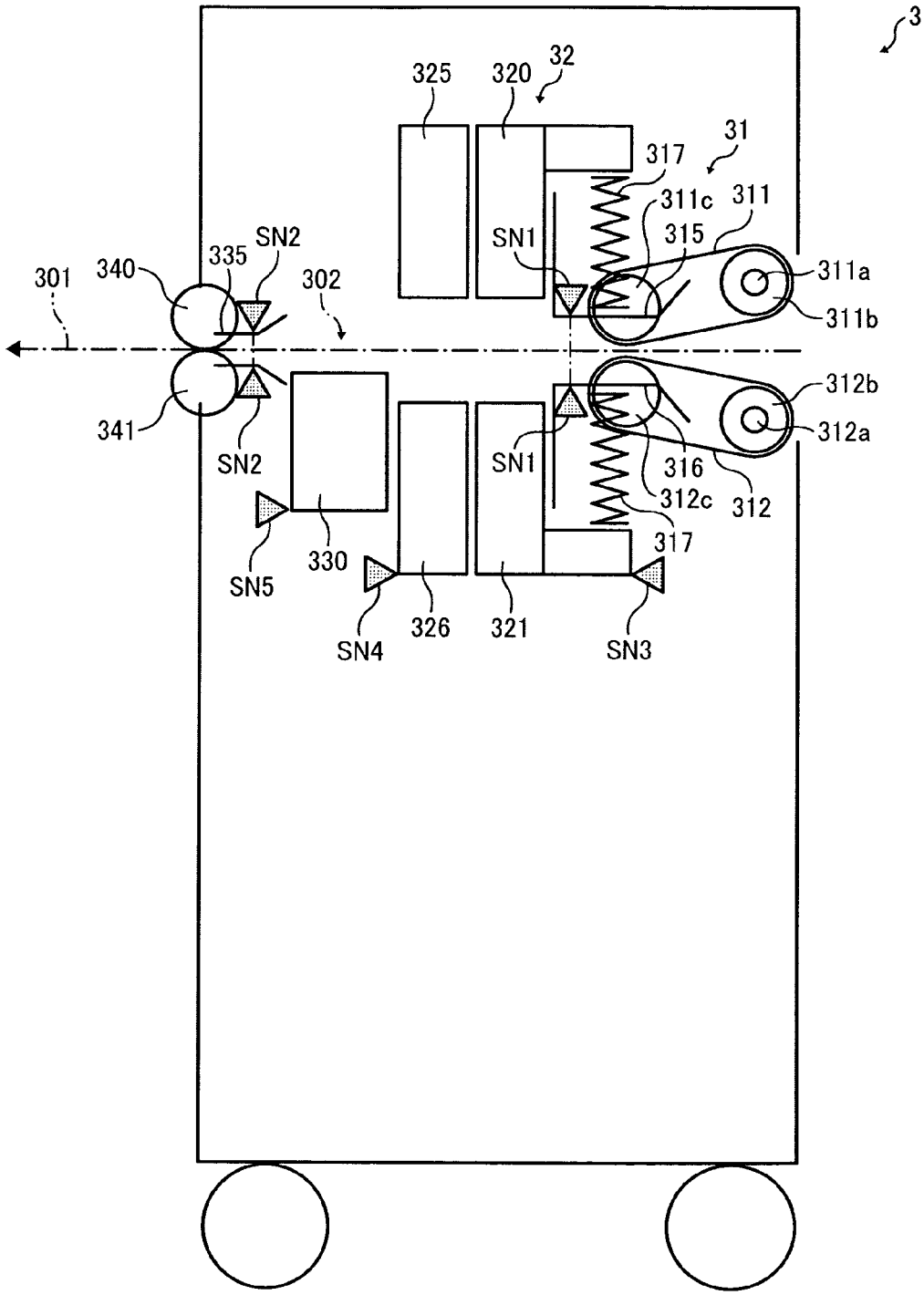
FIG. 17 is a front view illustrating a configuration of the spine formation devices shown in FIG. 10.

FIG. 17 is a front view illustrating a configuration of the spine formation device 3 shown in FIG. 10.

Referring to FIG. 17, the spine formation device 3 includes the conveyance unit 31, the clamping unit, the contact member, and the discharge unit disposed in that order in the sheet conveyance direction.

The conveyance unit 31 includes the vertically-arranged conveyance belts 311 and 312. Vertically-arranged guide plates 315 and 316 and the vertically-arranged auxiliary pressure plates 320 and 321 together form an auxiliary clamping unit 32. The pressure plates 325 and 326 together form the clamping unit. The discharge unit includes a discharge guide plate 335 and the pair of discharge rollers 340 and 341 in FIG. 17. It is to be note that the lengths of the respective components are greater than the width of the bundle of sheets SB in a direction perpendicular to the surface of paper on which FIG. 17 is drawn.

The upper conveyance belt 311 and the lower conveyance belt 312 are respectively stretched around driving pulleys 311*b* and 312*b* supported by swing shafts 311*a* and 312*a* and driven pulleys 311*c* and 312*c* disposed downstream from the driving pulleys 311*b* and 312*b*. The driven pulleys 311*c* and 312*c* face each other via a transport centerline 301. A driving motor, not shown, drives the conveyance belts 311 and 312. The swing shafts 311*a* and 312*a* respectively support the conveyance belts 311 and 312 swingably so that the gap between the driven pulleys 311*c* and 312*c* is adjusted corresponding to the thickness of the booklet SA.

Figure 18A:
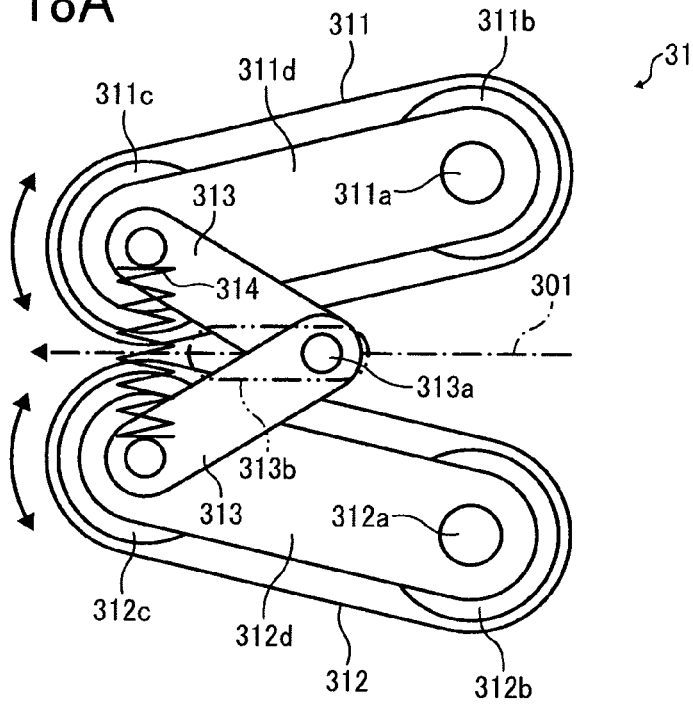
FIG. 18A illustrates an initial state of a transport unit of the spine formation device shown in FIG. 10 to transport a bundle of folded sheets.
Figure 18B:
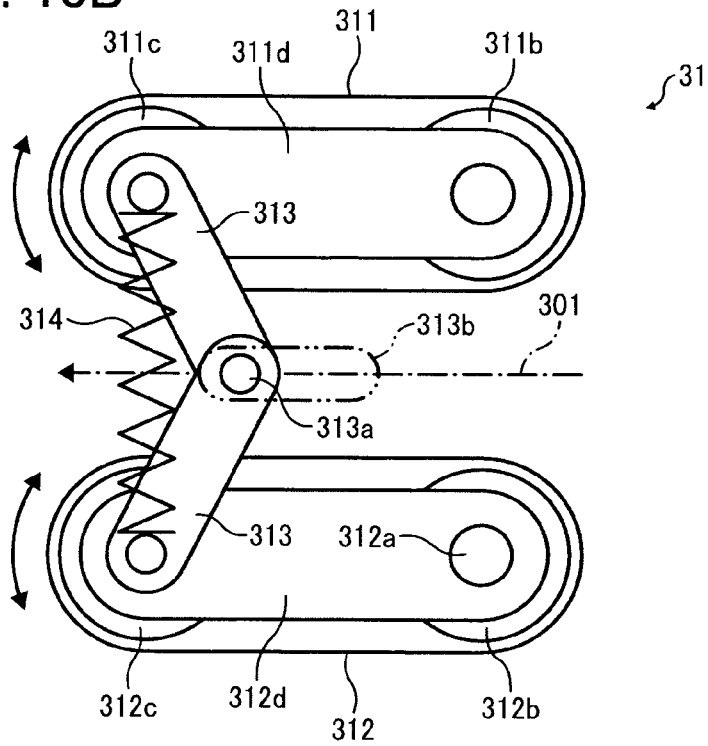
FIG. 18B illustrates a state of the transport unit shown in FIG. 10 in which the bundle of folded sheets is transported.

FIGS. 18A and 18B illustrate the conveyance unit 31 to transport the booklet SA using the vertically-arranged conveyance belts 311 and 312 in further detail. FIGS. 18A and 18B illustrate an initial state of the spine formation device 3 and a state in which the bundle of sheets SB is transported therein, respectively.

As shown in these figures, the driving pulleys 311*b* and 312*b* are connected to the driven pulleys 311*c* and 312*c* with support plates 311*d* and 312*d*, respectively, and the conveyance belts 311 and 312 are respectively stretched around the driving pulleys 311*b* and 312*b* and the driven pulleys 311*c* and 312*c*. With this configuration, the conveyance belts 311 and 312 are driven by the driving pulleys 311*b* and 312*b*, respectively.

By contrast, rotary shafts of the driven pulleys 311*c* and 312*c* are connected by a link 313 formed with two members connected movably with a connection shaft 313*a*, and a pressure spring 314 biases the driven pulleys 311*c* and 312*c* to approach each other. The connection shaft 313*a* engages a slot 313*b* extending in the sheet conveyance direction, formed in a housing of the spine formation device 3 and can move along the slot 313*b*. With this configuration, as the two members forming the link 313 attached to the driven pulleys 311*c* and 312*c* move, the connection shaft 313*a* moves along the slot 313*b* as shown in FIG. 18B, thus changing the distance between the driven pulleys 311*c* and 312*c* corresponding to the thickness of the booklet SA while maintaining a predetermined or given pressure in a nip where the conveyance belts 311 and 312 press against each other.

Additionally, a rack-and-pinion mechanism can be used to move the connection shaft 313*a* along the slot 313*b*, and the position of the connection shaft 313*a* can be set by controlling a motor driving the pinion. With this configuration, when the booklet SA is relatively thick, the distance between the driven pulleys 311*c* and 312*c* (hereinafter "transport gap") can be increased to receive the booklet SA, thus reducing the pressure applied to the folded portion (folded leading-edge portion) of the booklet SA by the conveyance belts 311 and 312 on the side of the driven pulleys 311*c* and 312*c*. It is to be noted that, when power supply to the driving motor is stopped after the folded portion of the booklet SA is sandwiched between the conveyance belts 311 and 312, the driven pulleys 311*c* and 312*c* can transport the booklet SA sandwiched therebetween with only the elastic bias force of the pressure spring 314.

Figure 19A:
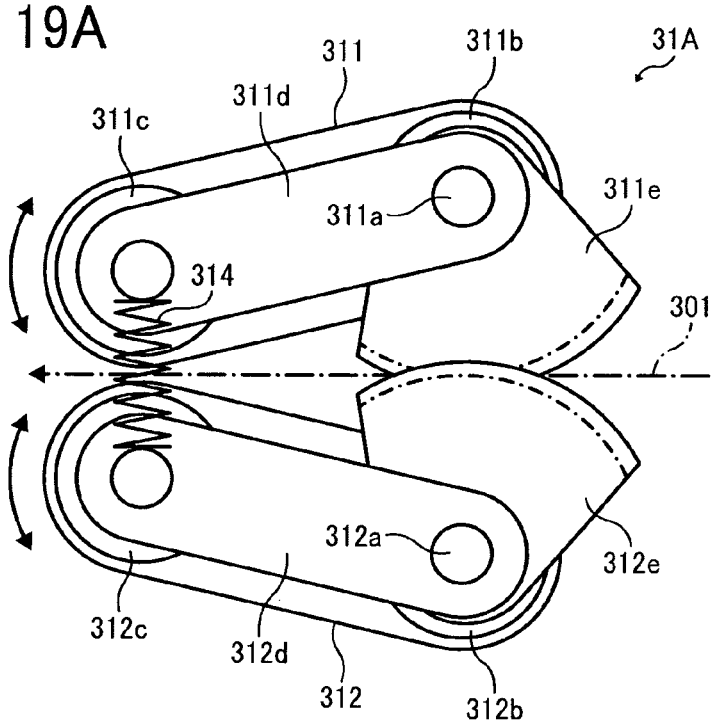
FIGS. 19A and 19B are diagrams of another configuration of the transport unit and illustrate an initial state and a state when the bundle of folded sheets is transported thereto, respectively.
Figure 19B:
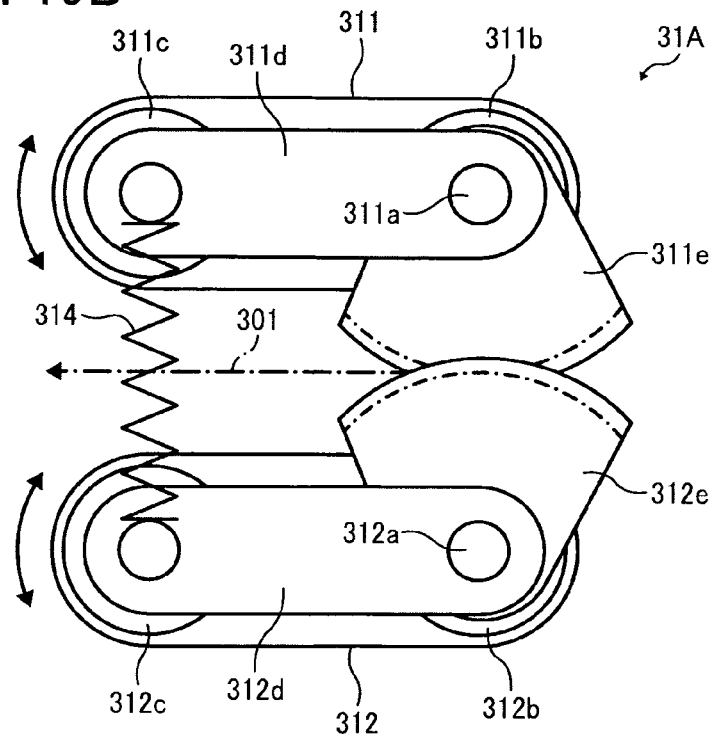

FIGS. 19A and 19B illustrate a conveyance unit 31A in which, instead of using the link 313, the swing shafts 311*a* and 312*a* engage sector gears 311*e* and 312*e*, respectively, and the sector gears 311*e* and 312*e* engaging each other cause the driven pulleys 311*c* and 312*c* to move away from the transport centerline 301 symmetrically. FIGS. 19A and 19B illustrate an initial state of the conveyance unit 31A and a state in which the booklet SA is transported therein, respectively.

Also in this configuration, the size of the transport gap to receive the booklet SA can be adjusted by driving one of the sector gears 311*e* and 312*e* with a driving motor including a decelerator similarly to the configuration shown in FIGS. 18A and 18B.

As shown in FIG. 17, the guide plates 315 and 316 are arranged symmetrically on both sides of the transport centerline 301, adjacent to the driven pulleys 311*c* and 312*c*, respectively. The guide plates 315 and 316 respectively include flat surfaces facing the transport path 302, extending from the transport nip to a position adjacent to the auxiliary pressure plates 320 and 321, and the flat surfaces serve as transport surfaces. The upper guide plate 315 and the lower guide plate 316 are attached to the upper auxiliary pressure plate 320 and the lower auxiliary pressure plate 321 with pressure springs 317, respectively, biased to the transport centerline 301 elastically by the respective pressure springs 317, and can move vertically. Further, the auxiliary pressure plates 320 and 321 are held by a housing of the spine formation device 3 movably in the vertical direction in FIG. 17. It is to be noted that, alternatively, the guide plates 315 and 316 may be omitted, and the booklet SA may be guided by only surfaces of the auxiliary pressure plates 320 and 321 facing the booklet SA.

The vertically-arranged auxiliary pressure plates 320 and 321 of the auxiliary clamping unit 32 approach and move away from each other symmetrically about the transport centerline 301 similarly to the conveyance belts 311 and 312. A driving mechanism, not shown, provided in the auxiliary clamping unit 32 for this movement can use the link mechanism used in the conveyance unit 31 or the connection mechanism using the rack and the sector gear shown FIGS. 19A and 19B. A reference position used in detecting a displacement of the auxiliary pressure plates 320 and 321 can be set with the output from the auxiliary pressure plate HP detector SN3. Because the vertically-arranged auxiliary pressure plates 320 and 321 and the driving unit, not shown, are connected with a spring similar to the pressure spring 314 in the conveyance unit 31, or the like, when the booklet SA is sandwiched by the auxiliary pressure plates 320 and 321, damage to the driving mechanism caused by overload can be prevented. The surfaces of the auxiliary pressure plates 320 and 321 (e.g., pressure applying surfaces) that squeezes the booklet SA are flat surfaces in parallel to the transport centerline 301.

The vertically-arranged pressure plates 325 and 326, serving as the clamping unit, approaches and moves away from each other symmetrically about the transport centerline 301 similarly to the conveyance belts 311 and 312. A driving mechanism to cause the pressure plates 325 and 326 to perform this movement can use the link mechanism used in the conveyance unit 31 or the connection mechanism using the rack and the sector gear shown FIGS. 19A and 19B. A reference position used in detecting a displacement of the pressure plates 325 and 326 can be set with the output from the pressure plate HP detector SN4. Other than the description above, the pressure plates 325 and 326 have configurations similar the auxiliary pressure plates 320 and 321 and operate similarly thereto, and thus descriptions thereof are omitted. It is to be noted that a driving source such as a driving motor is requisite in the auxiliary clamping unit 32 and the clamping unit although it is not requisite in the transport unit 30, and the driving source enables the movement between a position to sandwich the booklet and a standby position away form the booklet SA. The surfaces of the pressure plates 325 and 326 (e.g., pressure sandwiching surfaces) that sandwich the booklet SA are flat surfaces in parallel to the transport centerline 301 similarly to the auxiliary pressure plates 320 and 321.

The contact plate 330 is disposed downstream from the pressure plates 325 and 326. The contact plate 330 and a mechanism, not shown, to move the contact plate 330 vertically in FIG. 17 together form a contact unit. The contact plate 330 moves vertically in the drawing to obstruct the transport path 302 and away from the transport path 302, and a reference position used in detecting a displacement of the contact plate 330 can be set with the output from a contact plate HP detector SN5. When the contact plate 330 is away from the transport path 302, a top surface of the contact plate 330 serves as a transport guide for the booklet SA. Therefore, the top surface of the contact plate 330 is flat, in parallel to the sheet conveyance direction, that is, the transport centerline 301. For example, although not shown in the drawings, the mechanism to move the contact plate 330 can include rack-and-pinions provided on both sides of the contact plate 330, that is, a front side and a back side of the spine formation device 3, and a driving motor to drive the pinions. With this configuration, the contact plate 330 can be moved vertically and set at a predetermined position by driving the driving motor.

It is to be noted that the respective portions of the spine formation device 3 can be controlled by a CPU of a control circuit of the spine formation device 2 that is similar to the control circuit 110, shown in FIG. 28, of the post-processing apparatus 2. Further, the control circuit 110 of the post-processing apparatus 2 and the control circuit of the spine formation device 3 are connected serially to the control circuit of the image forming apparatus 1. The data relating to the bundle of sheets from the image forming apparatus 1 is transmitted to the post-processing apparatus 2 and further to the spine formation device 3, and the CPUs of the post-processing apparatus 2 and the spine formation device 3 perform control required for their operations and report the completion of the operations therein to the control circuit of the image forming apparatus 1, respectively.

Referring to FIGS. 20 through 26, spine formation performed by the spine formation device 3 is described below. The spine formation device 3 can flatten the spine of the booklet SA as well as the adjacent portions on the front cover side and the bock cover side.

Figure 20:
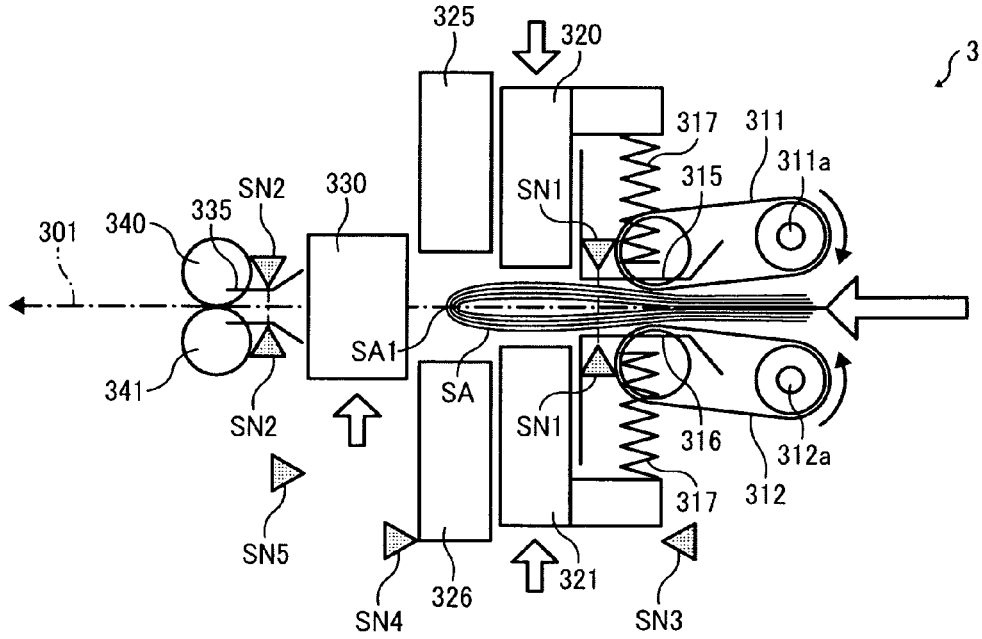
FIG. 20 illustrates a state of the spine formation device when the bundle of folded sheets is transported therein.

Referring to FIG. 20, according to a detection signal of the booklet SA generated by an entrance sensor, not shown, of the spine formation device 3 or the folded portion detector 293 (shown in FIG. 11) of the post-processing apparatus 2, the respective portions of the spine formation device 3 perform preparatory operations to receive the booklet SA. In the preparatory operations, the pair of conveyance belts 311 and 312 starts rotating. Additionally, the upper auxiliary pressure plate 320 and the lower auxiliary pressure plate 321 move to the respective home positions detected by the auxiliary pressure plate HP detector SN3, move toward the transport centerline 301 until the distance (transport gap) therebetween becomes a predetermined distance, and then stop at those positions. Similarly, the upper pressure plate 325 and the lower pressure plate 326 move to the respective home positions detected by the pressure plate HP detector SN4, move toward the transport centerline 301 until the distance (transport gap) therebetween becomes a predetermined distance, and then stop at those positions.

It is to be noted that, because the pair of auxiliary pressure plates 320 and 321 as well as the pair of pressure plates 325 and 326 are disposed and move symmetrically about the transport centerline 301, when only one of the counterparts in the pair is detected at the home position, it is known that the other is at the home position as well. Therefore, the auxiliary pressure plate HP detector SN3 and the pressure plate HP detector SN4 are disposed on only one side of the transport centerline 301.

In addition, the contact plate moves to the position detected by the contact plate HP detector SN5 (home position), further moves toward the transport centerline 301*a* predetermined distance, and then stops at the position shown in FIG. 20, obstructing the transport path 302. This state before the booklet SA enters the spine formation device 3 is shown in FIG. 17. In this state, the conveyance belts 311 and 312 are driven and the booklet SA forwarded by the discharge rollers 231 of the post-processing apparatus 2 is transported by the conveyance belts 311 and 312 inside the spine formation device 3 as shown in FIG. 20.

Then, operation similar to that illustrated in FIGS. 9A through 9D regarding the first embodiment is performed. More specifically, a target position, that is, the spine formation position (second position) at which the booklet SA is clamped by the clamping unit 32 and flattened by the contact plate 330 is downstream from a position (e.g., an upstream edge of the contact plate 330) at which the front end of the booklet SA contacts the contact plate 330 by the amount necessary (deformation amount) for expanding the folded portion SA1 in the thickness direction to form a flat spine. The distance from the position where the booklet SA is detected by the transport detector SN1 to the spine formation position is hereinafter referred to as a predetermined transport distance.

After the transport detector SN1 detects the folded portion SA1 of the booklet SA, the conveyance belts 311 and 312 transport the booklet SA to the first position, which is downstream in the sheet conveyance direction from the contact position with the contact plate 330 by the sum of the amount necessary for forming the spine and the amount by which the booklet SA is reversed to cancel out the extra length (S2-S1). The extra length (S2-S1) equals the center projection amount S.

Subsequently, the control circuit (shown in FIG. 28) causes the conveyance unit 31 to reduce the pressure between the conveyance belts 311 and 312, thereby reducing the projection amount of the inner sheet Sin of the booklet SA. Then, the pressure between the conveyance belts 311 and 312 is again increased. The reduction in the pressure to adjust the projection amount of the inner sheet Sin is within an extent that no gaps are created between sheets similarly to the first embodiment. Subsequently, the conveyance belts 311 and 312 rotate in reverse to reverse the booklet SA by the center projection amount S to cancel out the extra length (S2−S1), after which the operation illustrated in FIGS. 21 through 26 is performed.

It is to be noted that the predetermined transport distance is set corresponding to the data relating to the booklet SA such as the sheet thickness, the sheet size, the number of sheets, and the special sheet classification of the booklet SA.

Figure 21:
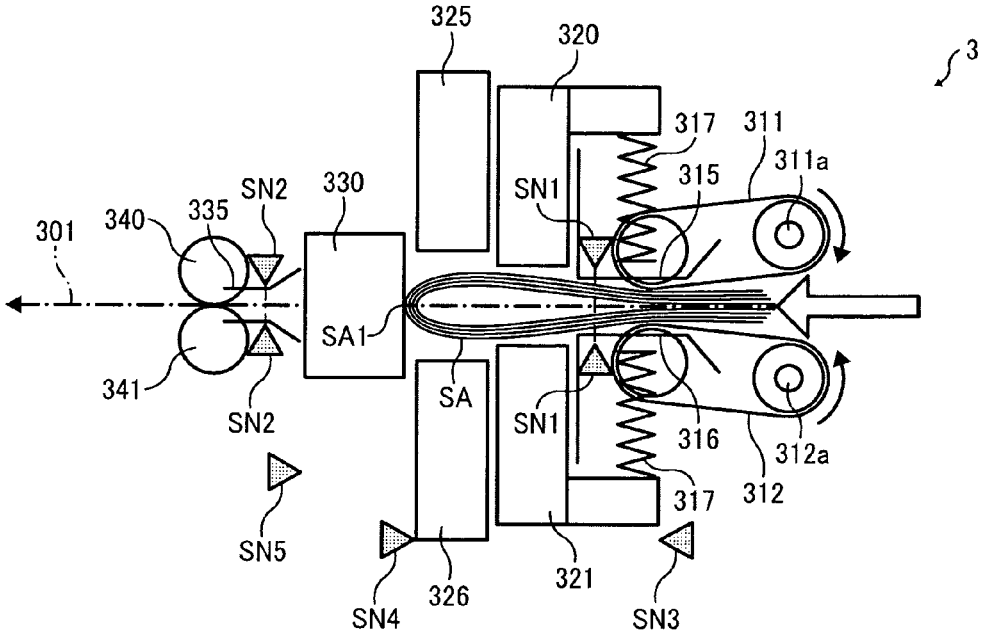
FIG. 21 illustrates a process of spine formation performed by the spine formation device, in which the leading edge of the bundle of folded sheets is in contact with a contact plate.
Figure 22:
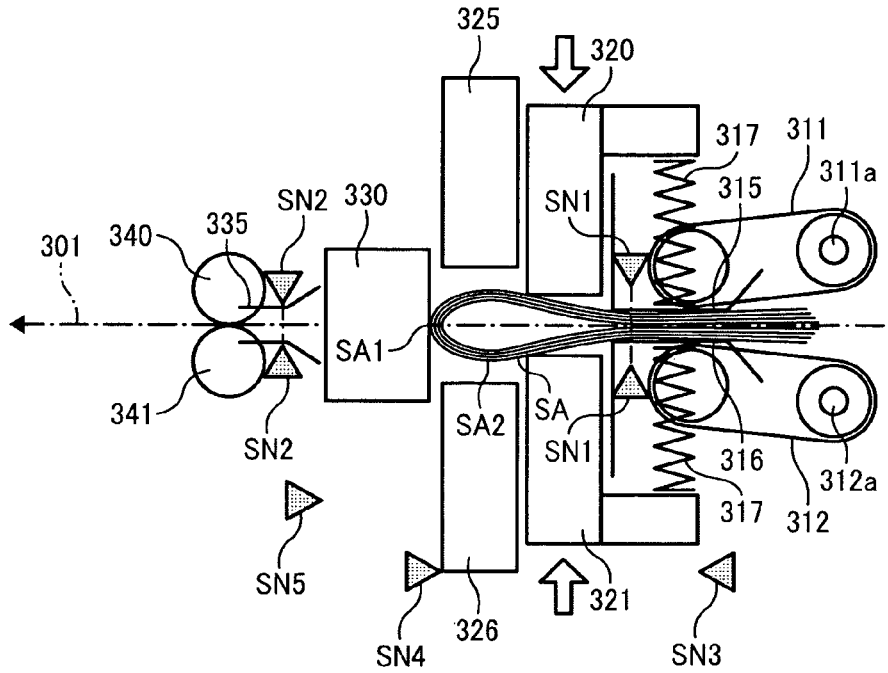
FIG. 22 illustrates a process of spine formation performed by the spine formation device, in which a pair of auxiliary pressure plates approaches the bundle of folded sheets to squeeze it.
Figure 23:
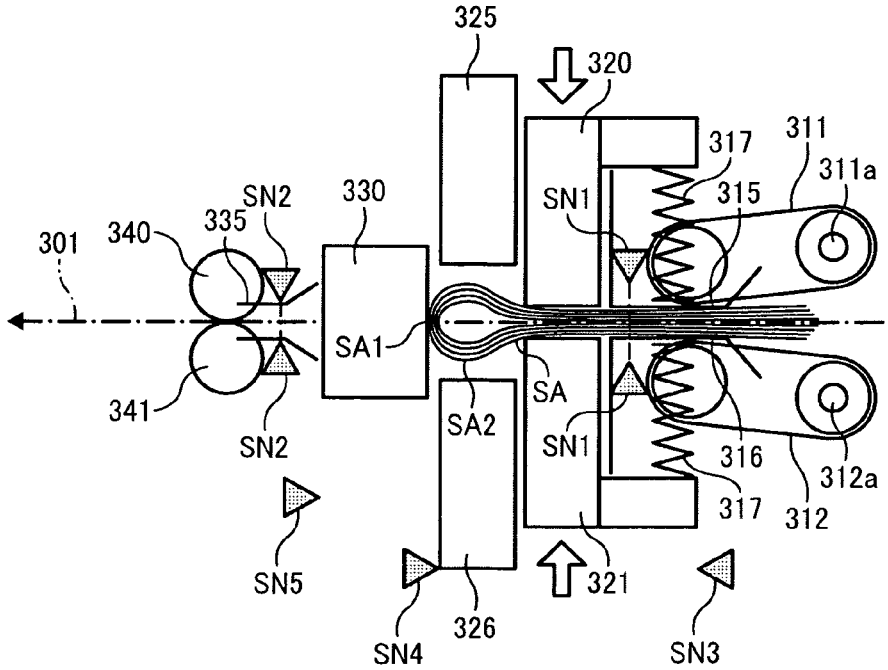
FIG. 23 illustrates a process of spine formation performed by the spine formation device, in which the pair of auxiliary pressure plates squeezes the bundle of folded sheets.

When the booklet SA is stopped in the state shown in FIG. 21, referring to FIG. 22, the auxiliary pressure plates 320 and 321 start approaching the transport centerline 301, and the pair of guide plates 315 and 316 presses against the booklet SA sandwiched therein with the elastic force of the pressure springs 317 initially. After the pair of guide plates 315 and 316 start applying a predetermined pressure to the booklet SA, the auxiliary pressure plates 320 and 321 further approach the transport centerline 301 to squeeze the booklet SA in the portion downstream form the portion sandwiched by the guide plates 315 and 316 and then stop moving when the pressure to the booklet SA reaches a predetermine or given pressure. Thus, the booklet SA is held with the predetermined pressure as shown in FIG. 23. It is to be noted that reference character SA4 represents a bulging portion of the booklet SA upstream from the folded leading edge. With the folded leading-edge portion SA1 of the booklet SA pressed against the contact plate 330, the bulging portion SA4 upstream from the folded leading-edge portion SA1 is larger than that shown in FIG. 22.

Figure 24:
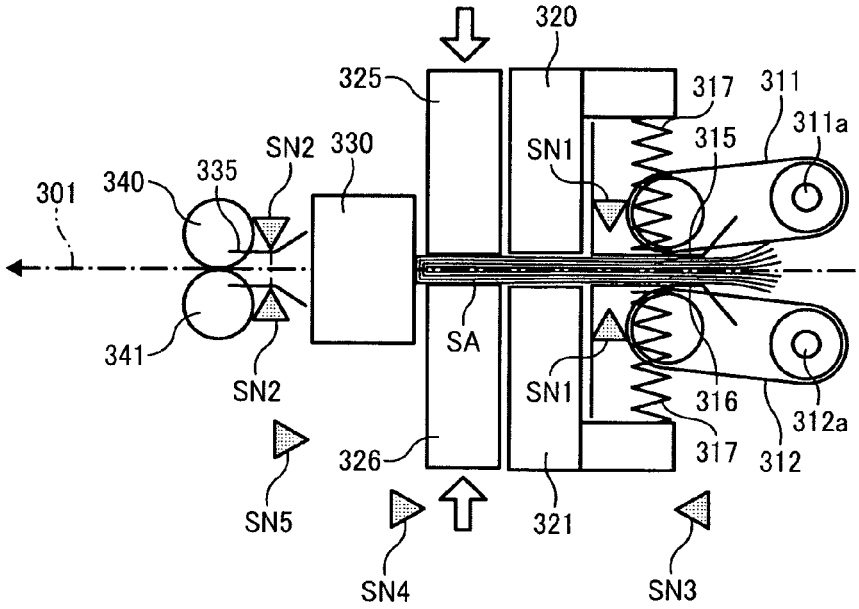
FIG. 24 illustrates a process of spine formation performed by the spine formation device, in which a pair of pressure plates squeezes the bundle of folded sheets.

After the auxiliary pressure plates 320 and 321 squeeze the booklet SA as shown in FIG. 23, the pressure plates 325 and 326 start approaching the transport centerline 301 as shown in FIG. 24. With this movement, the bulging portion SA4 is localized to the side of the folded leading-edge portion SA1, pressed gradually, and then deforms following the shape of the space defined by the pair of pressure plates 325 and 326 and the contact plate 330. After this compressing operation is completed, the folded portion SA1 of the booklet SA is flat following the surface of the contact plate 330, and thus the flat spine SA2 is formed on the booklet SA. In addition, portions SA5 and SA6 on the front side (front cover) and the back side (back cover) adjacent to the leading edge of the booklet SA are flattened as well. Thus, booklets having square spines can be produced (shown in FIG. 26).

Figure 26:
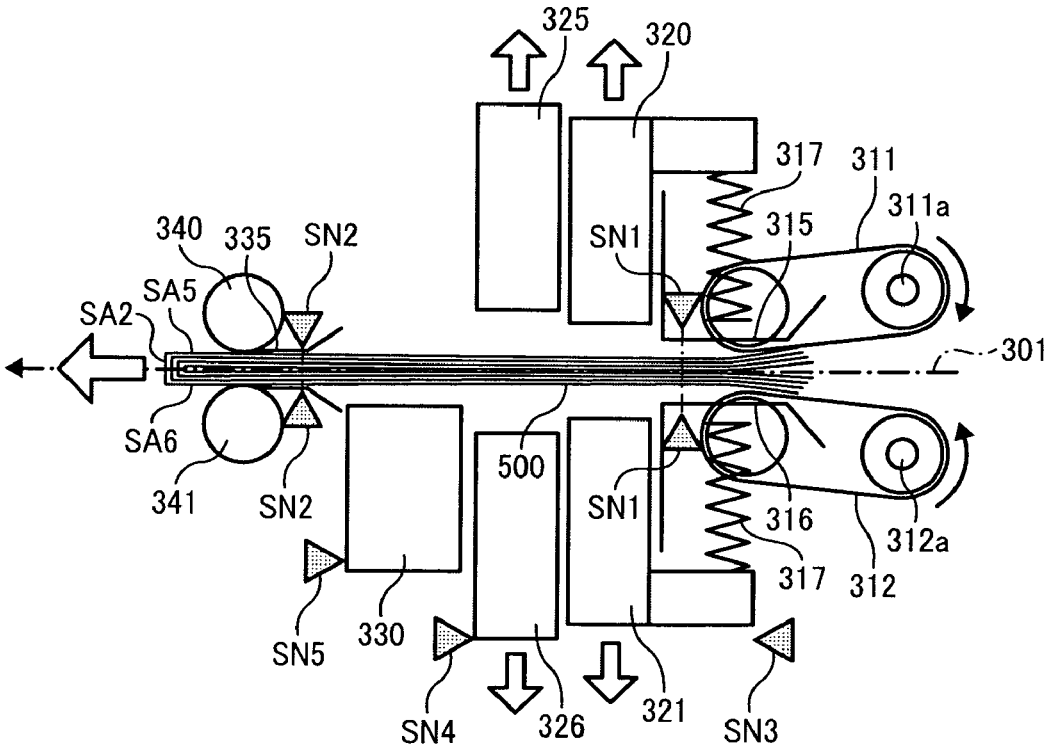
FIG. 26 illustrates a state in which the bundle of folded sheets is discharged from the spine formation device after spine formation.

Subsequently, as shown in FIG. 26, the auxiliary pressure plates 320 and 321 and the pressure plates 325 and 326 move away from the booklet SA to predetermined or given positions (standby positions), respectively. The contact plate 330 moves toward the home position and stops at a position where the top surface thereof guides the booklet SA.

Figure 25:
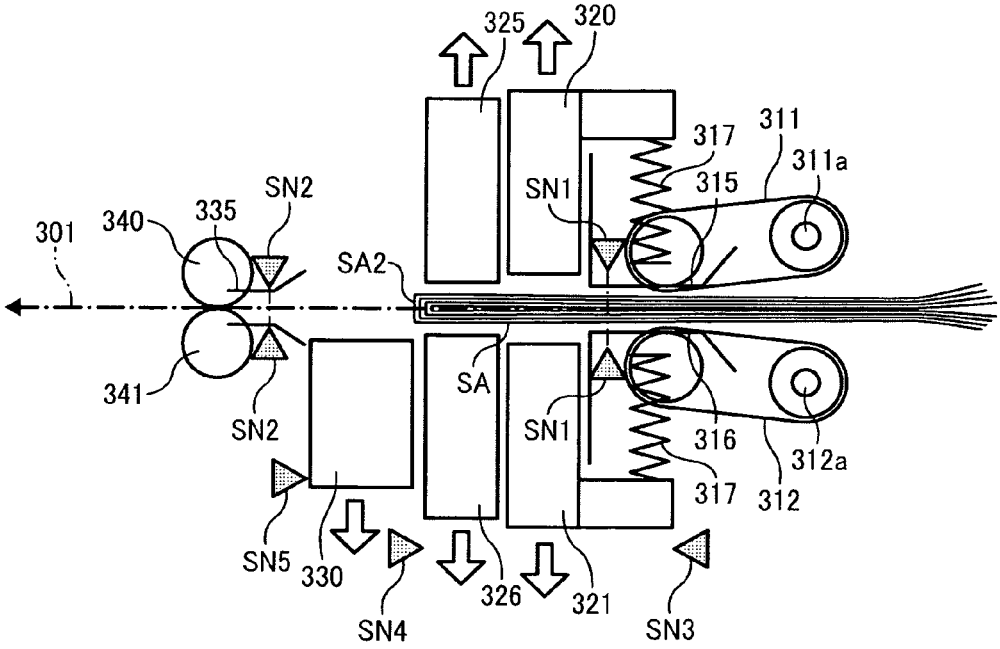
FIG. 25 illustrates completion of spine formation performed by the spine formation device, in which the pair of auxiliary pressure plates and the pair of pressure plates are disengaged from the bundle of folded sheets.

After the auxiliary pressure plates 320 and 321, the pressure plates 325 and 326, and the contact plate 330 reach the respective standby positions, as shown in FIG. 25, the conveyance belts 311 and 312 and the pair of discharge rollers 340 and 341 start rotating, thereby discharging the booklet SA outside the spine formation device 3. Thus, a sequence of spine formation operations is completed. The conveyance belts 311 and 312 and the pair of discharge rollers 340 and 341 stop rotating after a predetermined time period has elapsed from the detection of the booklet SA by the discharge detector N2. Simultaneously, the respective movable portions return to their home positions. When subsequent booklets SA are sequentially sent form the post-processing apparatus 2, the time point at which the rotation of the conveyance belts 311 and 312 and the discharge rollers 340 and 341 is stopped is varied according to the transport state of the subsequent booklet SA. Additionally, it may be unnecessary to return the respective movable portions to their home positions each time, and the position to receive the booklet SA may be varied according to the transport state of and the data relating to the subsequent booklet SA. It is to be noted that the CPU of the above-described control circuit performs these adjustments.

Third Embodiment

Figure 27:
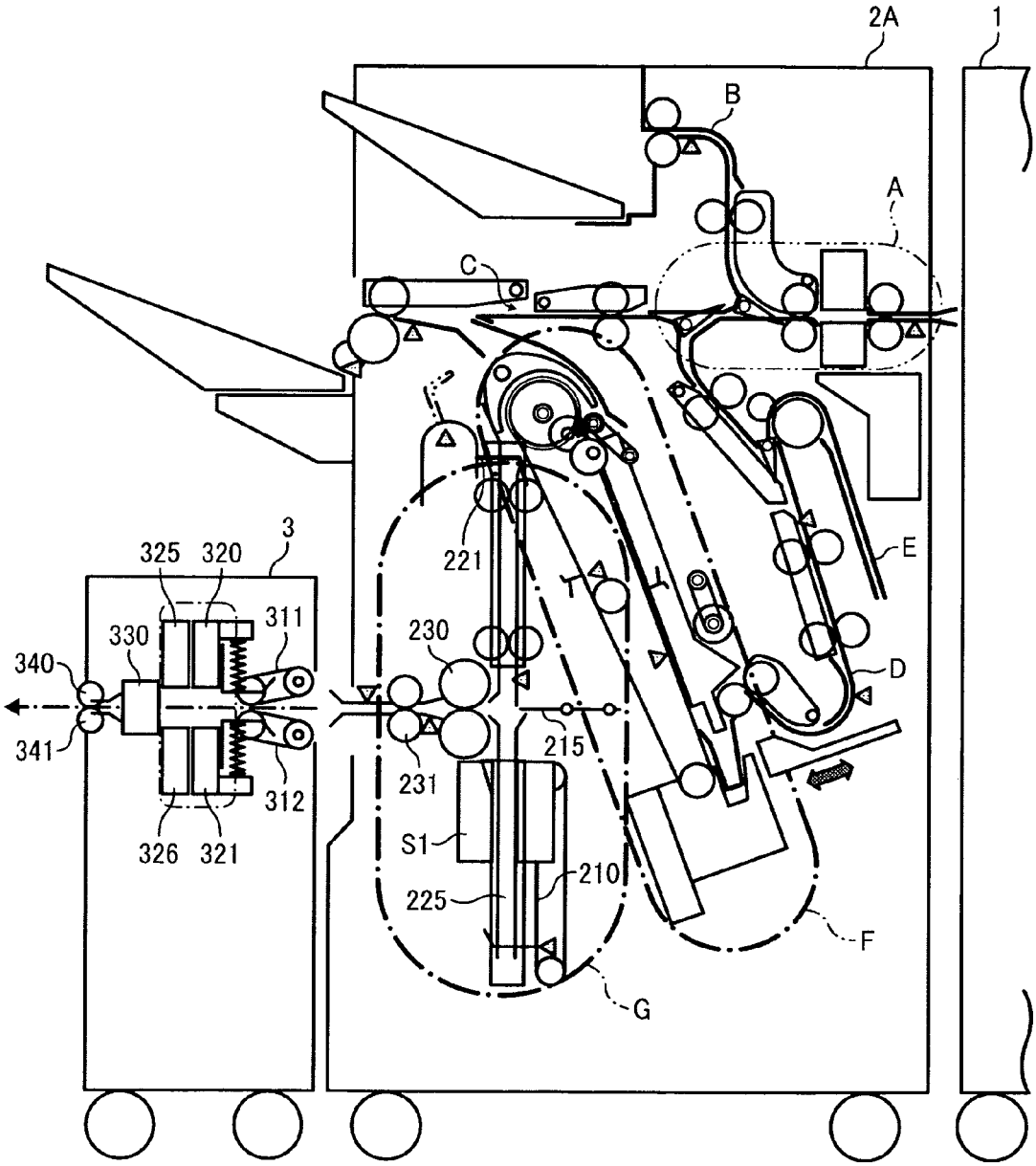
FIG. 27 illustrates a spine formation system including a post-processing apparatus and a spine formation device according to another embodiment of the present invention.

FIG. 27 illustrates a sheet processing system according to a third embodiment including a post-processing apparatus 2A that is a so-called finisher.

In the third embodiment, the device to perform saddle-stapling and center folding is incorporated in the post-processing apparatus 2A capable of other sheet processing such as sorting and punching of sheets, and the spine formation device 3 forms the spine of booklets SA saddle-stapled and folded in two in the post-processing apparatus 2A. The configuration of the spine formation device 3 is identical or similar to that shown in FIG. 17, and the configuration of the center stapling and center-folding mechanism is identical or similar to that shown in FIG. 11. Thus, descriptions thereof are omitted.

The post-processing apparatus 2A includes an entrance path A along which sheets of recording media transported form an image forming apparatus 1 to the post-processing apparatus 2A are initially transported, a transport path B leading from the entrance path A to a proof tray (not shown), a shift tray path C leading from the entrance path A to a shift tray (not shown), a transport path D leading from the entrance path A to a edge-stapling tray F, a storage area E disposed along the transport path D, and a saddle processing tray G disposed downstream from the edge-stapling tray F in the sheet conveyance direction. The spine formation device 3 is connected to a downstream side of the post-processing apparatus 2A in the sheet conveyance direction.

The edge-stapling tray F aligns multiple sheets and, as required, staples an edge portion of the aligned sheets as a booklet SB. The booklet SB processed on the edge-stapling tray F are stored in the storage area E and then transported to the edge-stapling tray F at a time. The sheets transported along the entrance path A or discharged from the edge-stapling tray F are transported along the shift tray path C to the shift tray. The saddle processing tray G perform folding and/or saddle-stapling, that is, stapling along a centerline, of the multiple sheets aligned on the edge-stapling tray F into a booklet SA. Then, the spine formation device 3 flattens a folded edge (spine) of the booklet SA.

It is to be noted that the post-processing apparatus 2A has a known configuration and performs known operations, which are briefly described below.

The sheets transported to the post-processing apparatus 2A to be stapled along its centerline are stacked on the edge-stapling tray F sequentially. A jogger fence (not shown) aligns the sheets placed on the edge-stapling tray F in a width direction or transverse direction, which is perpendicular to the sheet conveyance direction. Further, a roller (not shown) pushes the sheets so that a trailing edge of the sheet contacts a back fence (not shown) disposed an upstream side in the sheet conveyance direction while a release belt (not shown) rotates in reverse so that a leading edge of the sheets is pressed by a back of a release pawl (not shown) disposed on a down stream side in the sheet conveyance direction, and thus a bundle of sheets are aligned in the sheet conveyance direction. After the sheets are aligned in the sheet conveyance direction as well as in the width direction, the release pawl and a pressure roller (not shown) turn the bundle of sheets a relatively large angle along a guide roller (not shown) to the saddle processing tray G.

Then, the bundle of sheets SB in the saddle processing tray G is further transported to a movable fence 210, and a pair of saddle stapling fences 225 aligns the sheets in the width direction. Further, the trailing edge of the bundle of sheets SB is pushed to an aligning pawl 221, and thus alignment in the sheet conveyance direction is performed. After the alignment, the saddle stapler S1 staples the bundle of sheets along its centerline into a booklet SB as bookbinding. Then, the movable fence 210 pushes a center portion (folded position) of the booklet SB to a position facing a folding plate 215. The folding plate 215 moves horizontally in FIG. 27, which is perpendicular to the sheet conveyance direction, and a leading edge portion of the folding plate 215 pushes the folded position of the booklet SB between a pair of folding rollers 230, thereby folding the booklet SB in two (booklet SA). Then, a pair of discharge rollers 231 forwards the folded booklet SA to the spine formation device 3.

As the spine formation device 3 has a configuration identical or similar to that shown in FIGS. 17 through 19B and performs operations identical or similarly to those shown in FIGS. 20 through 26, the similar descriptions are omitted.

It is to be noted that the driving mechanisms of the conveyance unit, the auxiliary clamping unit, the clamping unit, and the contact member in the second and third embodiments are not limited to the above-described mechanisms, and other known mechanisms can be used.

Numerous additional modifications and variations are possible in light of the above teachings. It is therefore to be understood that, within the scope of the appended claims, the disclosure of this patent specification may be practiced otherwise than as specifically described herein.

What is claimed is:

1. A spine formation device for forming a spine of a bundle of folded sheets, the spine formation device comprising:

a sheet conveyer that conveys the bundle of folded sheets with a folded portion of the bundle forming a front end portion of the bundle;

a clamping unit disposed downstream from the sheet conveyer in a sheet conveyance direction in which the bundle of folded sheets is transported, the clamping unit movable in a direction of thickness of the bundle to clamp the bundle with the folded portion of the bundle projecting from a downstream end of the clamping unit in the sheet conveyance direction;

a spine forming member disposed downstream from the clamping unit in the sheet conveyance direction to flatten the folded portion of the bundle into a square spine; and a controller operatively connected to the sheet conveyer as well as the clamping unit, wherein the controller causes the sheet conveyer to transport the bundle of folded sheets to a first position a predetermined distance downstream in the sheet conveyance direction from a second position at which the bundle is clamped by the clamping unit and to reverse the bundle from the first position to the second position before the clamping unit clamps the bundle.

2. The spine formation device according to claim 1, wherein the sheet conveyer comprises a pair of rotary members to press against the bundle of folded sheets from both sides in the direction of thickness of the bundle, and before the sheet conveyer reverses the bundle from the first position to the second position, the pair of rotary members of the sheet conveyer reduces a pressure applied to the bundle and are again pressed against the bundle.

3. The spine formation device according to claim 1, wherein the predetermined distance by which the bundle of folded sheets is reversed equals an amount to cancel out a difference between S1 and S2, wherein S1 represents a difference in length between an inner circumference and an outer circumference of the folded portion of the bundle of folded sheets before flattened by the spine forming member and S2 represents a difference in length between an inner circumference and an outer circumference of the folded portion of the bundle flattened by the spine forming member.

4. The spine formation device according to claim 1, wherein the second position is downstream in the sheet conveyance direction from an upstream end of the spine forming member by an amount necessary for forming the square spine, and the first position is downstream by a sum of the amount necessary for forming the square spine and the predetermined distance from the upstream end of the spine forming member.

5. The spine formation device according to claim 1, wherein spine forming member is a roller to apply pressure to the folded portion of the bundle while rolling on the folded portion of the bundle longitudinally.

6. The spine formation device according to claim 1, wherein spine forming member is a contact member having a flat contact surface against which the folded portion of the bundle is pressed.

7. A sheet processing system comprising:

an image forming apparatus;

a sheet processing apparatus to fold a sheet; and a spine formation device for forming a spine of a bundle of folded sheets, the spine formation device including:

a sheet conveyer that conveys the bundle of folded sheets with a folded portion of the bundle forming a front end portion of the bundle;

a clamping unit disposed downstream from the sheet conveyer in a sheet conveyance direction in which the bundle of folded sheets is transported, the clamping unit movable in a direction of thickness of the bundle to clamp the bundle with the folded portion of the bundle projecting from a downstream end of the clamping unit in the sheet conveyance direction;

a spine forming member disposed downstream from the clamping unit in the sheet conveyance direction to flatten the folded portion of the bundle into a square spine; and a controller operatively connected to the sheet conveyer as well as the clamping unit, wherein the controller causes the sheet conveyer to transport the bundle of folded sheets to a first position a predetermined distance downstream in the sheet conveyance direction from a second position at which the bundle is clamped by the clamping unit and to reverse the bundle from the first position to the second position before the clamping unit clamps the bundle.

8. A spine formation method used in a spine formation device including a clamping unit and a spine forming member to flatten a folded portion of a bundle of folded sheets into a square spine, the method comprising:

conveying the bundle of folded sheets with the folded portion of the bundle forming a front end portion of the bundle to a first position a predetermined distance downstream in a sheet conveyance direction from a second position at which the bundle is clamped;

reversing the bundle a predetermined distance from the first position to a second position in the sheet conveyance direction;

clamping the bundle from both sides in a direction of thickness of the bundle with the folded portion of the bundle projecting from a downstream end of the clamping unit in the sheet conveyance direction; and flattening the folded portion of the bundle, wherein the predetermined distance by which the bundle is reversed equals an amount to cancel out a difference between S1 and S2, wherein S1 represents a difference in length between an inner circumference and an outer circumference of the folded portion of the bundle that is not flattened by the spine forming member and S2 represents a difference in length between an inner circumference and an outer circumference of the folded portion of the bundle flattened by the spine forming member.

* * * * *